US006820847B2

(12) United States Patent
Camarota et al.

(10) Patent No.: US 6,820,847 B2
(45) Date of Patent: Nov. 23, 2004

(54) TABLE LEG ATTACHMENT SYSTEM

(75) Inventors: Richard J. Camarota, Holland, MI (US); Richard Hartmann, Jr., Holland, MI (US)

(73) Assignee: ITC Incorporated, Holland, MI (US)

( * ) Notice: Subject to any disclaimer, the term of this patent is extended or adjusted under 35 U.S.C. 154(b) by 0 days.

(21) Appl. No.: 10/081,139

(22) Filed: Feb. 22, 2002

(65) Prior Publication Data

US 2003/0160139 A1 Aug. 28, 2003

(51) Int. Cl.[7] ..... F16M 11/16
(52) U.S. Cl. ..... 248/188; 248/188.9; 108/150
(58) Field of Search ..... 248/188, 188.1, 248/188.8, 151, 158; 108/150

(56) References Cited

U.S. PATENT DOCUMENTS

| | | | | |
|---|---|---|---|---|
| 1,653,897 A | * | 12/1927 | Farr | 131/241 |
| 3,119,588 A | * | 1/1964 | Keats | 248/158 |
| 3,207,462 A | * | 9/1965 | Zimmerman | 248/159 |
| 3,230,909 A | | 1/1966 | Watson | |
| 3,236,389 A | * | 2/1966 | Murdock | 211/85.4 |
| 3,348,797 A | | 10/1967 | Turbyfill | |
| 3,415,475 A | | 12/1968 | Goodman | |
| 3,464,662 A | | 9/1969 | Myers | |
| 4,501,404 A | | 2/1985 | Nelson | |
| 4,662,591 A | | 5/1987 | Encontre | |
| 4,718,624 A | * | 1/1988 | Greulich | 248/158 |
| 4,789,126 A | | 12/1988 | Rice et al. | |
| 4,925,140 A | | 5/1990 | Camarota | |
| 5,020,286 A | | 6/1991 | Hamar et al. | |
| 5,026,010 A | | 6/1991 | Camarota | |
| 5,087,011 A | | 2/1992 | Turner et al. | |
| 5,102,192 A | | 4/1992 | Barile, Sr. | |
| 5,121,891 A | | 6/1992 | Goldsmith | |
| 5,383,644 A | | 1/1995 | Huse | |
| 6,588,717 B2 | * | 7/2003 | Carnahan et al. | 248/188.8 |

FOREIGN PATENT DOCUMENTS

GB 221 847 9/1924

OTHER PUBLICATIONS

Twin Taper™ Table Leg & Base System (photocopy parts view (6 sheets) and advertisement (2 sheets) published before Feb. 22, 2001.

* cited by examiner

*Primary Examiner*—Korie Chan
(74) *Attorney, Agent, or Firm*—Fynn, Thiel, Boutell & Tanis, P.C.

(57) ABSTRACT

A pedestal includes a base is releasably fixed to an elongate post. The base includes an annular flange and a central plateau which has a central opening. At least one tongue extends from the plateau into the opening. A rim protrudes from the flange and is spaced radially outboard of the plateau. A spider is fixed on the post end and has at least one radially outwardly extending leg. The post has a first circumferential position in which the leg is located in the base central opening circumferentially offset from the tongue. The post has a second circumferential position in which the leg snugly underlies and is axially trapped by the tongue. One of the tongue and the leg have a circumferentially extending ramp surface tightly camingly engaged with an opposed surface of the other of the tongue and the leg in the post second position. In the post second position, the leg axially tightly abuts the plateau and the tongue tightly abuts the opposed surface. An annular member is axially movable on the post. The member has a first axial position relatively distant from the spider and a second axial position adjacent a lateral plane of the spider and engaging the base in a ramp and opposing surface disengagement inhibiting relation.

40 Claims, 23 Drawing Sheets

TABLE LEG ATTACHMENT SYSTEM

FIELD OF THE INVENTION

This invention is directed to a pedestal mountable on a first support structure for carrying a second support structure in spaced relation to the first support structure.

BACKGROUND OF THE INVENTION

Mountable pedestals configured to carry a supported structure have found considerable usefulness. More specifically, these mountable pedestals have been particularly useful for supporting tabletops, seats and other such items on the floor (e.g. deck) in recreational vehicles and boats.

Applicant has found that a combination of factors can increase the desirability of a particular pedestal. For instance, the pedestal should be quick and easy to attach and remove as to both the supported item and the floor. In addition, the pedestal should provide a sturdy location, with respect to the floor, of the item being supported. For example, if the pedestal is supporting a table, the pedestal should be configured to prevent excessive wobbling of the tabletop and to allow the table to support an acceptable load. Further, the pedestal should be aesthetically pleasing, or at the very least not aesthetically displeasing, to the viewer.

The assignee of the present application has manufactured commercially successful mountable pedestals for a number of years, but continues to try to improve such pedestals. The invention disclosed herein arises from that continued effort to improve upon existing pedestals.

SUMMARY OF THE INVENTION

This invention is directed to a new and useful pedestal. The pedestal includes a base that is releasably fixed to an elongate post. The base unit includes a base and a mounting assembly which is secured to the post. A central opening extends through the base. At least one tongue is provided on the base and extends into the central opening. A spider is fixed at an end of the post and has at least one radially outwardly extending leg. The post has a first circumferential position with respect to the base in which the at least one leg of the spider is located in the base central opening and is circumferentially offset from the at least one tongue. The post has a second circumferential position with respect to the base in which the at least one leg of the spider snugly underlies and is axially trapped by the at least one tongue. When the post is in the second circumferential position, a circumferentially extending ramp surface of one of the at least one tongue and the at least one leg is tightly camingly engaged with an opposed surface of the other of the at least one tongue and the at least one leg. An annular member is sleeved on the post and is axially movable thereon. The member has a first axial position relatively distant from the spider and a second axial position adjacent a lateral plane of the spider. When the annular member is in the second axial position, it engages the base in a manner which inhibits disengagement of the ramp surface and the opposed surface of the at least one tongue of the base and the at least one leg of the spider.

BRIEF DESCRIPTION OF THE DRAWINGS

FIG. 5A is an enlarged fragment view of the end cap of FIG. 5;

DETAILED DESCRIPTION

Figure 1:
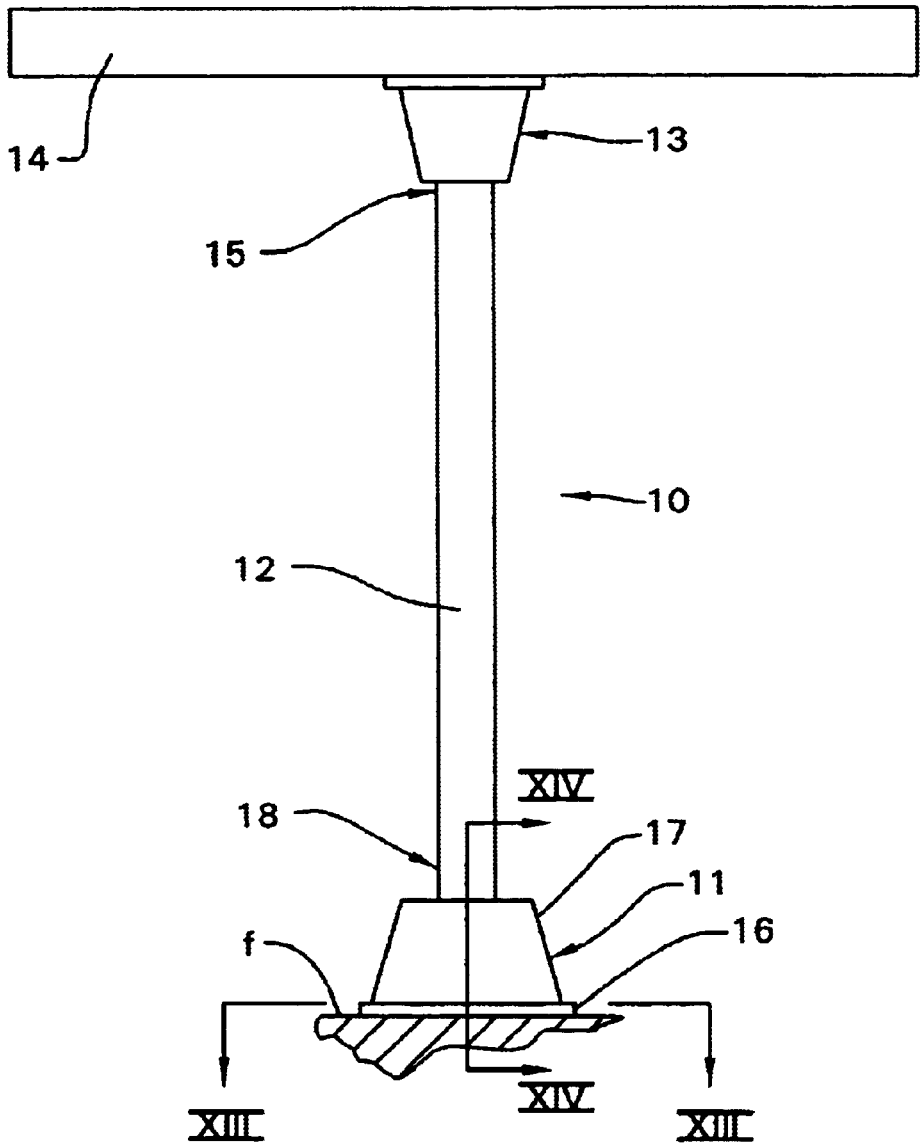
FIG. 1 is a side view of the pedestal according to a preferred embodiment of the present invention, such pedestal including a base unit, a pedestal upstanding from such base unit, and a connector unit mounted on such pedestal.

Referring now to FIG. 1 there is illustrated a mountable pedestal 10 embodying the present invention. The pedestal 10 includes a base unit 11 that is fixable on a floor f. A post 12 extends upward from the base unit 11. The post is preferably a hollow elongate rigid tube formed of a suitable material, such as aluminum. A connector unit 13 is mounted on an upper end of the post 12. The connector unit supports an item, such as a tabletop 14.

Figure 2:
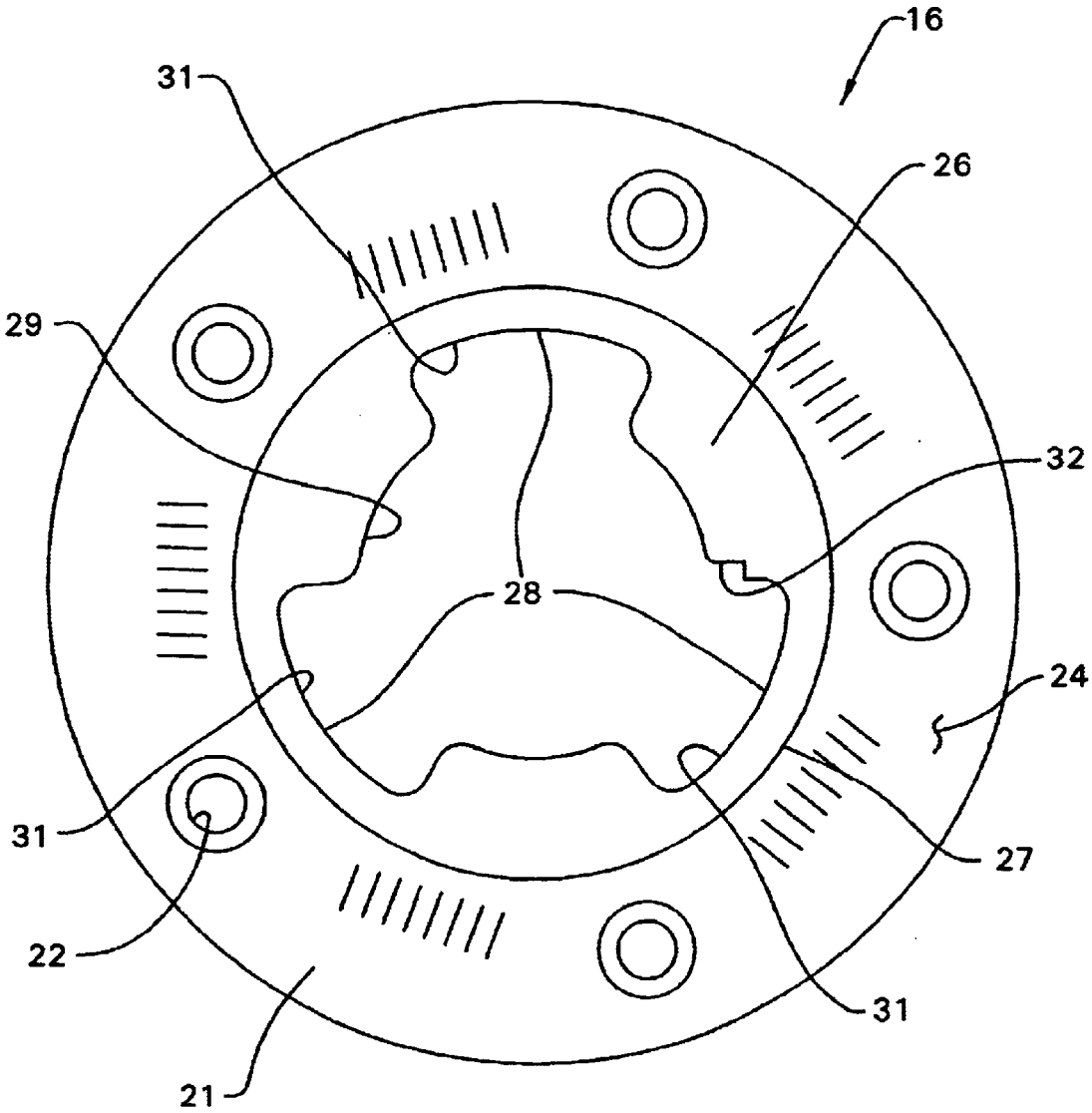
FIG. 2 is a top view of a base of the FIG. 1 base unit.
Figure 3:
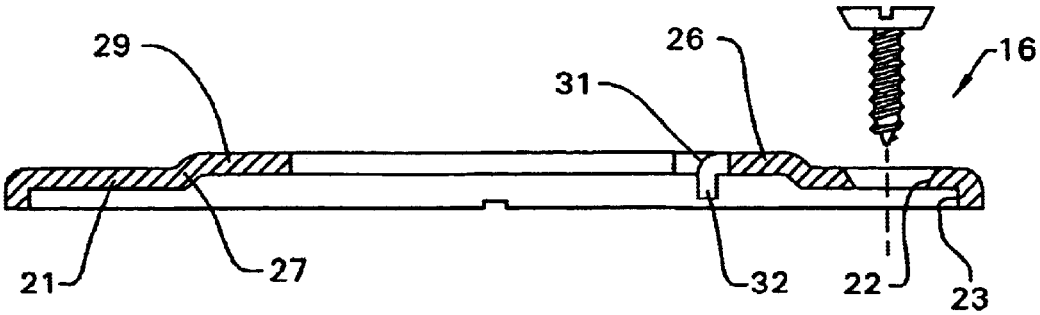
FIG. 3 is a cross sectional side view of the base of FIG. 2.

The base unit 11 includes a base 16 (FIGS. 2–3) and a mounting assembly 17. The mounting assembly 17 is secured to a lower end 18 of the post 12 and releasably engageable with the base 16. The base 16 includes an annular flange 21 and is preferably composed of aluminum or another suitable material. A plurality of spaced apart fastener holes 22 extend through the flange 21 (FIG. 2). A rim 23 extends downward from an outer edge of the flange 21 (FIG. 3). A top surface 24 of the flange 21 is scored (FIG. 2). The flange 21 surrounds a central plateau 26 which is stepped up from the flange 21 by an axially extending step 27. A central opening 28 is formed in the central plateau 26. Three tongues 29 extend into the opening 28 from the central plateau 26 (FIG. 2). The tongues 29 are equally spaced about the circumference of the central opening 28. The tongues 29 are spaced apart from one another by three notches 31. A stop 32 is formed in one of the notches 31.

Figure 4:
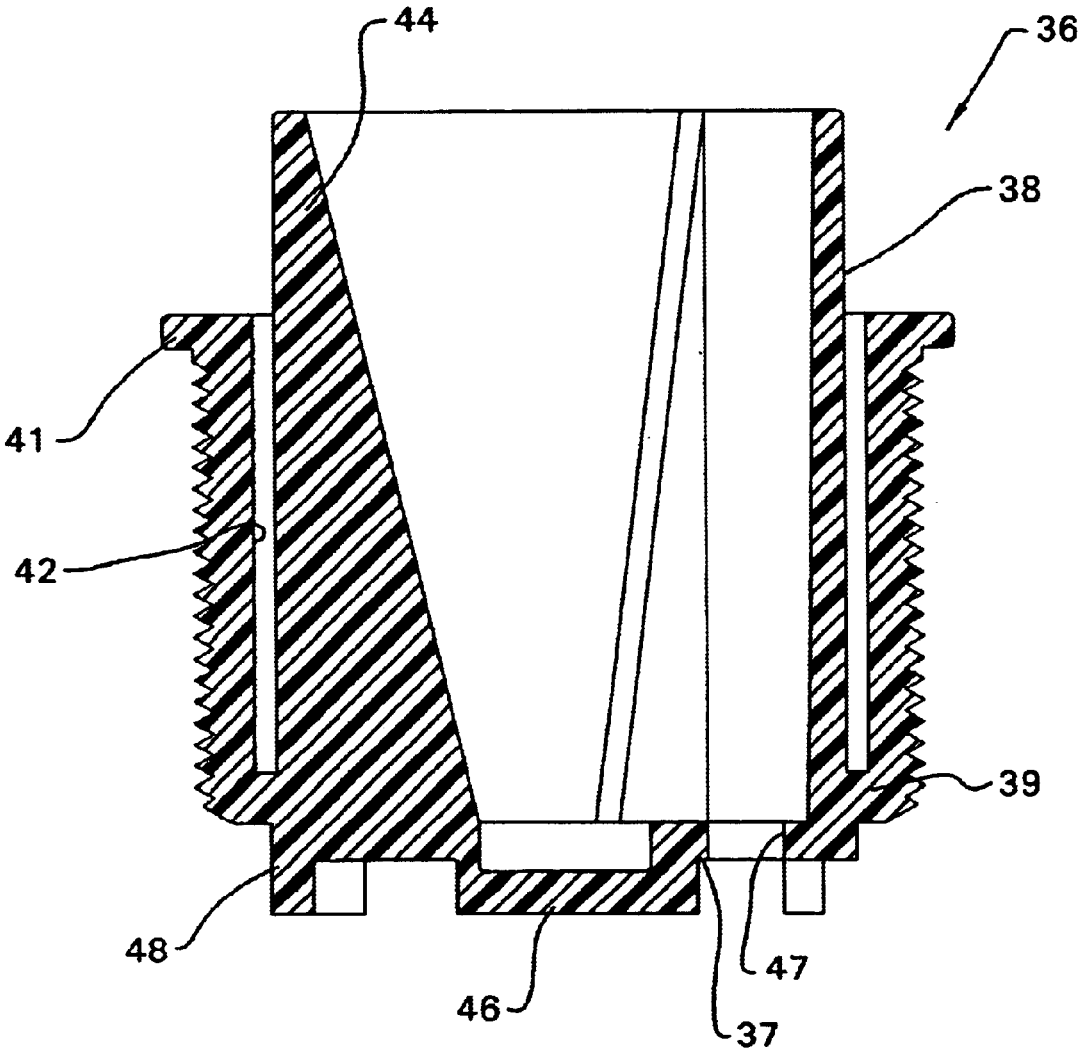
FIG. 4 is a central cross sectional view of an end cap of the FIG. 1 base unit.
Figure 5:
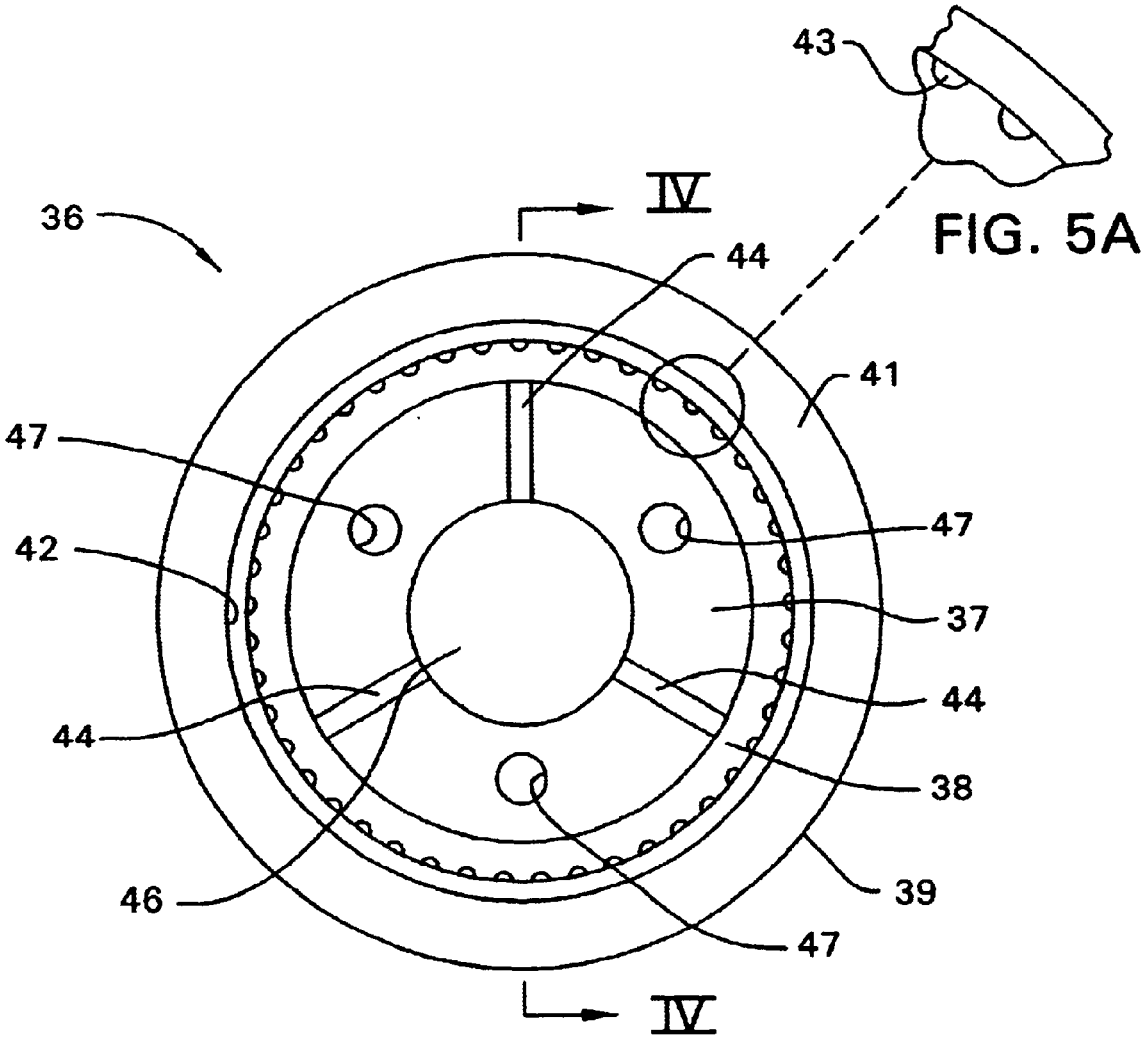
FIG. 5 is a top view of the FIG. 4 end cap.
Figure 6:
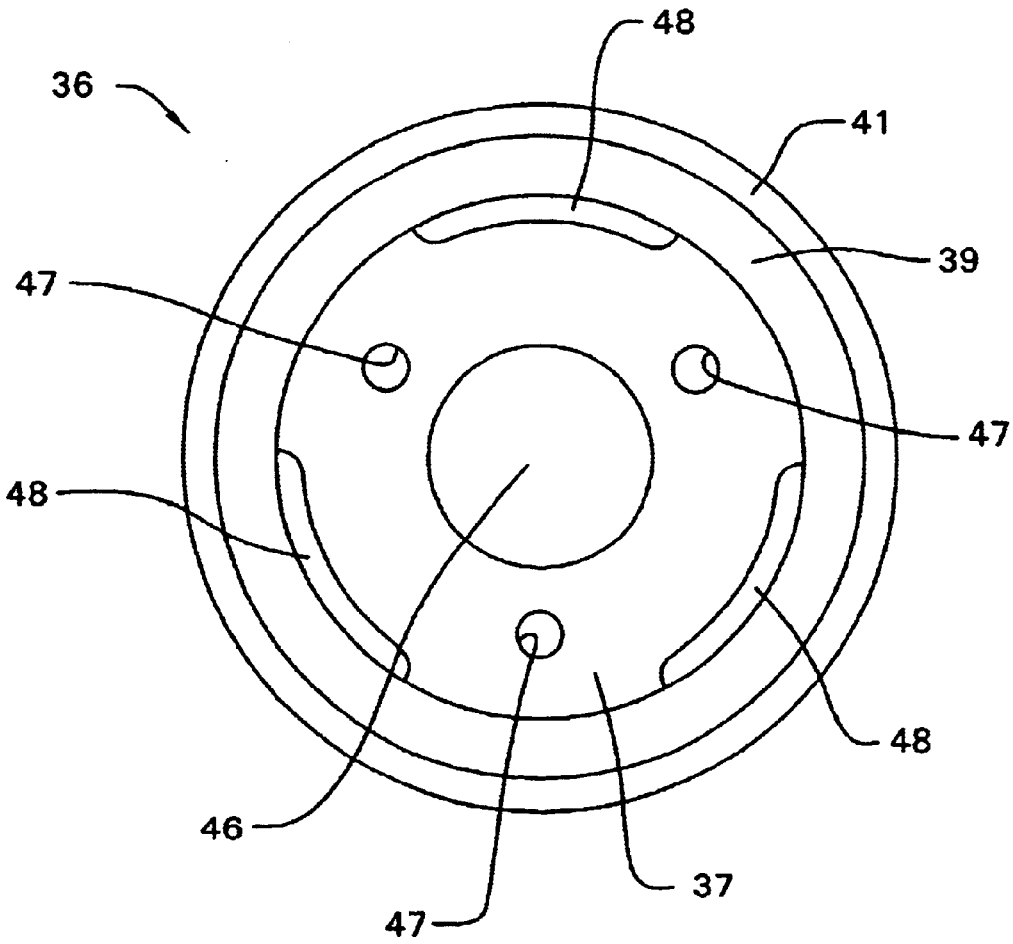
FIG. 6 is a bottom view of the FIG. 4 end cap.

The mounting assembly 17 includes a generally cup-shaped end cap 36 (FIGS. 4–6). The end cap 36 is preferably manufactured from a durable molded plastic or other suitable material. The end cap 36 includes a bottom end wall 37. The end cap 36 has inner and outer radial peripheral walls 38 and 39 that extend substantially upward from the end wall 37. The outer wall 39 terminates in an annular rim 41 (FIG. 4) that projects radially outward away from the inner wall 38. The inner and outer walls 38 and 39 are spaced apart by an annular groove 42 that opens upward. A peripheral surface of the inner wall 38 includes a plurality of ridges 43 (FIG. 5A). The ridges 43 will allow the post 12 to be more easily received by the end cap 36 and allow additional room for glue or another adhesive, if desired, between the post 12 and the end cap 36. An outer peripheral surface of the outer wall 39 of the end cap 36 is threaded. The inner wall 38 includes a number of buttresses 44.

A locator 46 (FIG. 5) projects downward from the center of the end wall 37 of the end cap 36. A plurality of spaced apart fastener holes 47 extend through the end wall 37 (FIGS. 5 and 6). Three ribs 48 extend downward from the end wall 37 and are equally spaced about the circumference of the end wall 37. As best illustrated in FIG. 6, the ribs 48 are positioned so they are centered between the fastener holes 47.

Figure 7A:
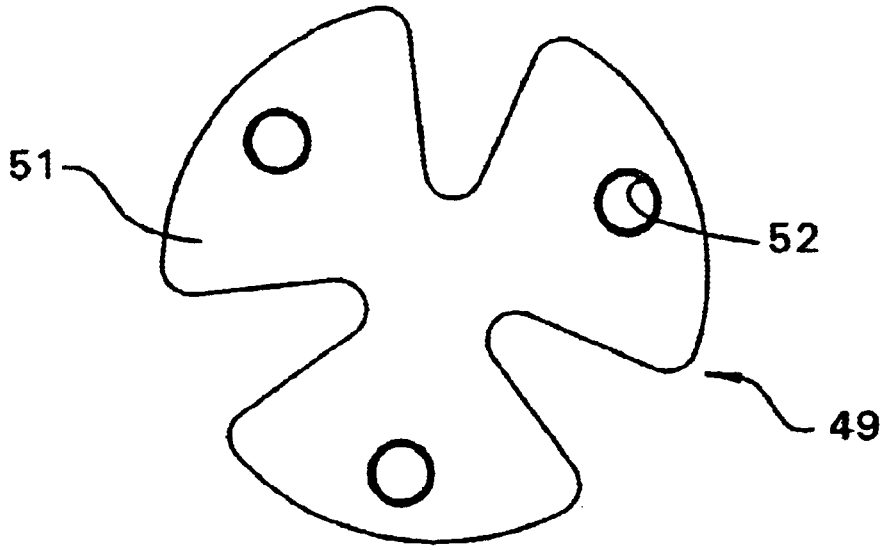
FIG. 7A is a top view of a screw mounting block of the FIG. 1 base unit.
Figure 7B:
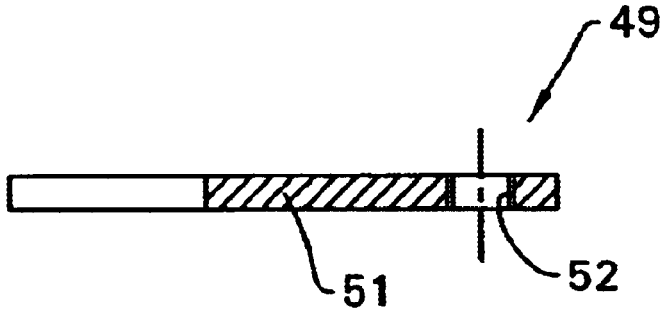
FIG. 7B is a cross sectional side view of the FIG. 7A screw mounting block.

The mounting assembly 17 includes a screw mounting block 49 (FIGS. 7A–7B) that is positioned in the end cap 36. The screw mounting block 49 includes three legs 51 that extend radially outward. A fastener hole 52 extends through each leg 51.

Figure 8:
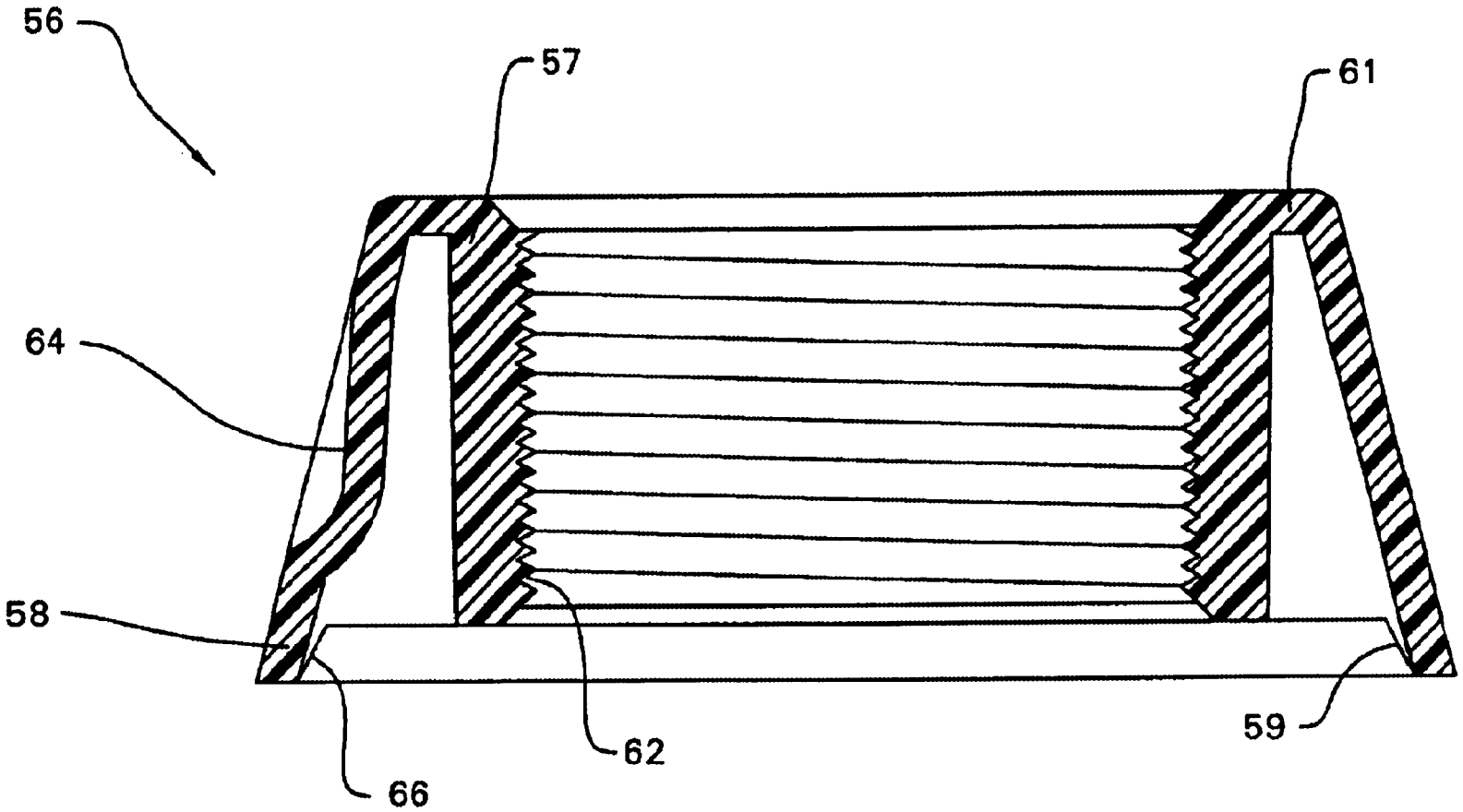
FIG. 8 is a cross sectional view of an annular member of the FIG. 1 base unit.
Figure 9:
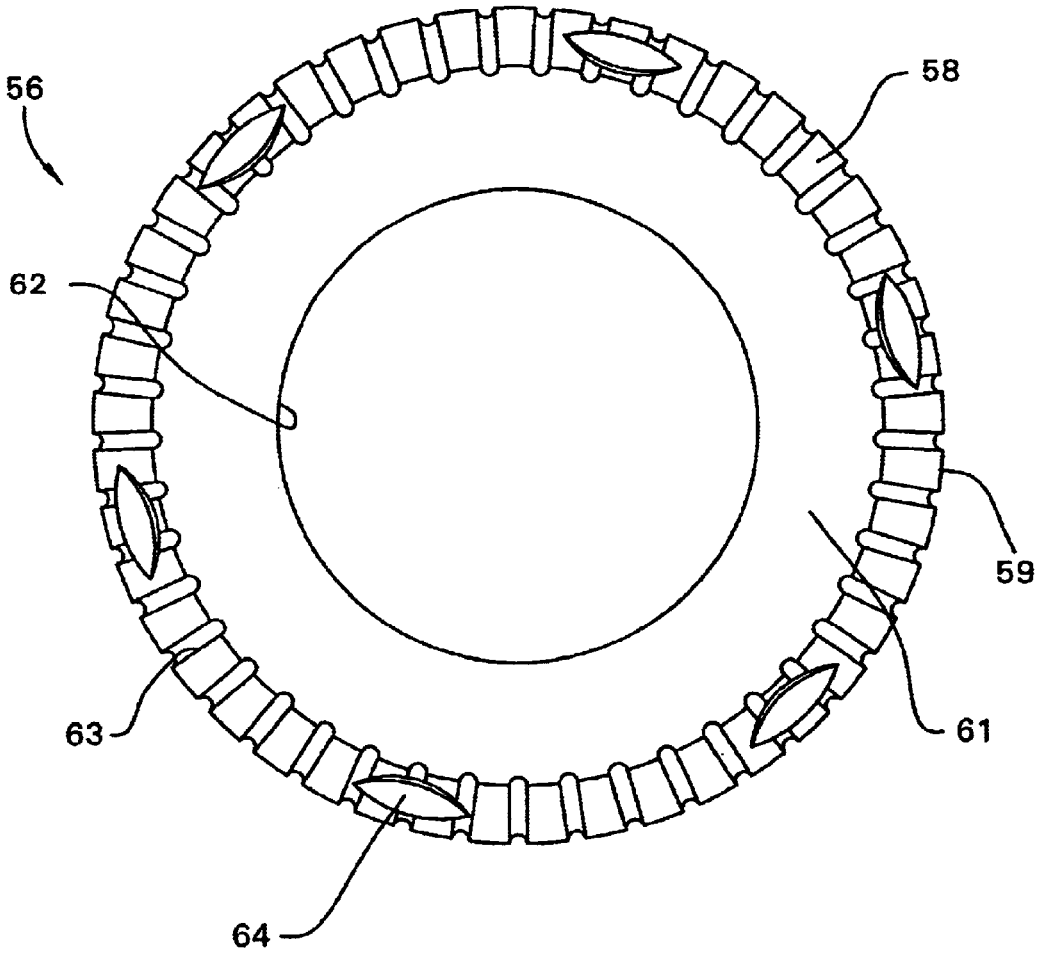
FIG. 9 is a top view of the FIG. 8 annular member.
Figure 10:
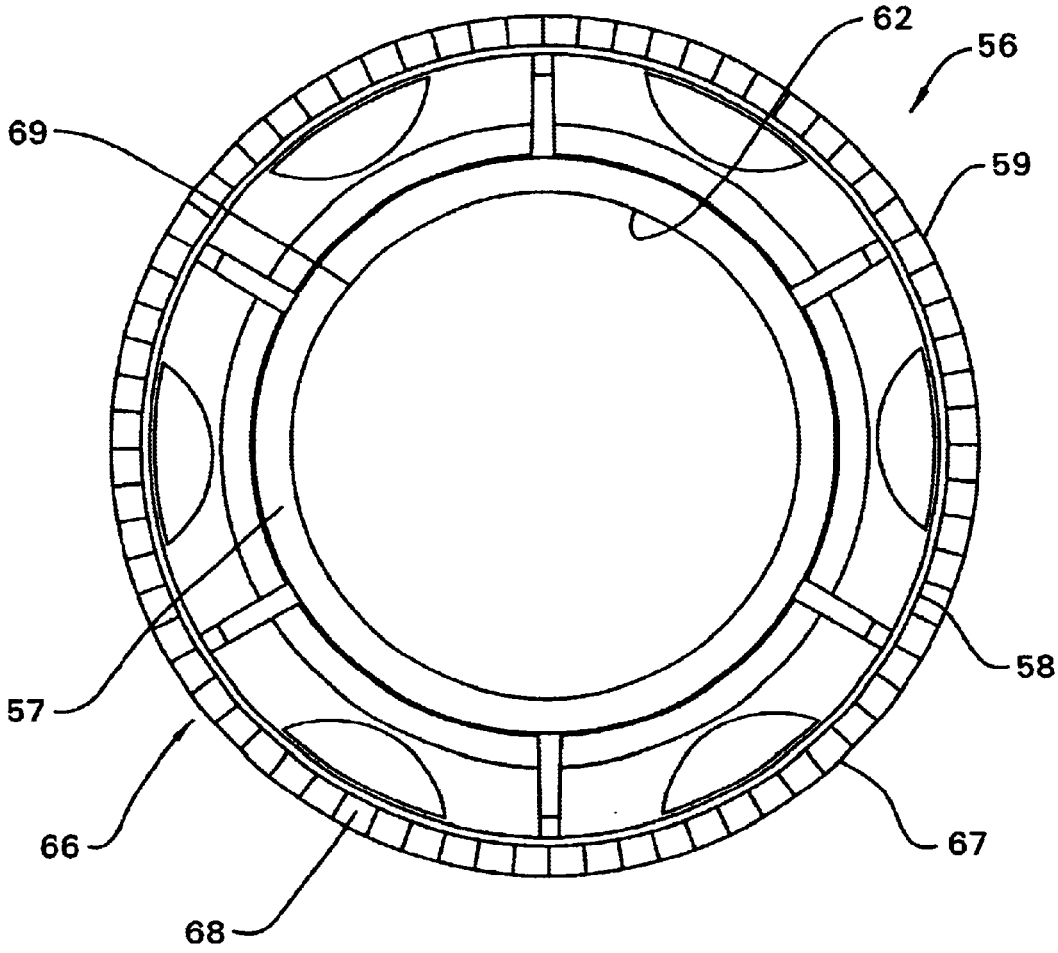
FIG. 10 is a bottom view of the FIG. 8 annular member.

Referring to FIGS. 8–10, the mounting assembly 17 includes an annular member 56. As illustrated, the annular member 56 is a nut which is composed of a suitable material, such as a durable moldable plastic. The nut 56 has inner and outer peripheral surfaces 57 and 58 (FIG. 8). The outer peripheral surface 58 is tapered so the circumference of a bottom end 59 of the nut 56 is greater than the circumference of a top end 61 of the nut 56. The inner peripheral surface 57 is threaded and surrounds a central recess 62 that extends between the top and bottom ends 61 and 59 of the nut 56. Preferably, the outer peripheral surface 58 of the nut 56 includes a plurality of ridges 63 and contours 64 to facilitate easier gripping and manipulation of the nut 56 by a user (FIG. 9). As best illustrated in FIG. 10, the bottom end 59 of the nut 56 is generally cup-shaped and includes a skirt 66 which surrounds the central recess 62. The skirt 66 includes a free end 67 that has an edge 68 which extends around a bottom surface 69. The edge 68 of the skirt 66 is scored.

Figure 11:
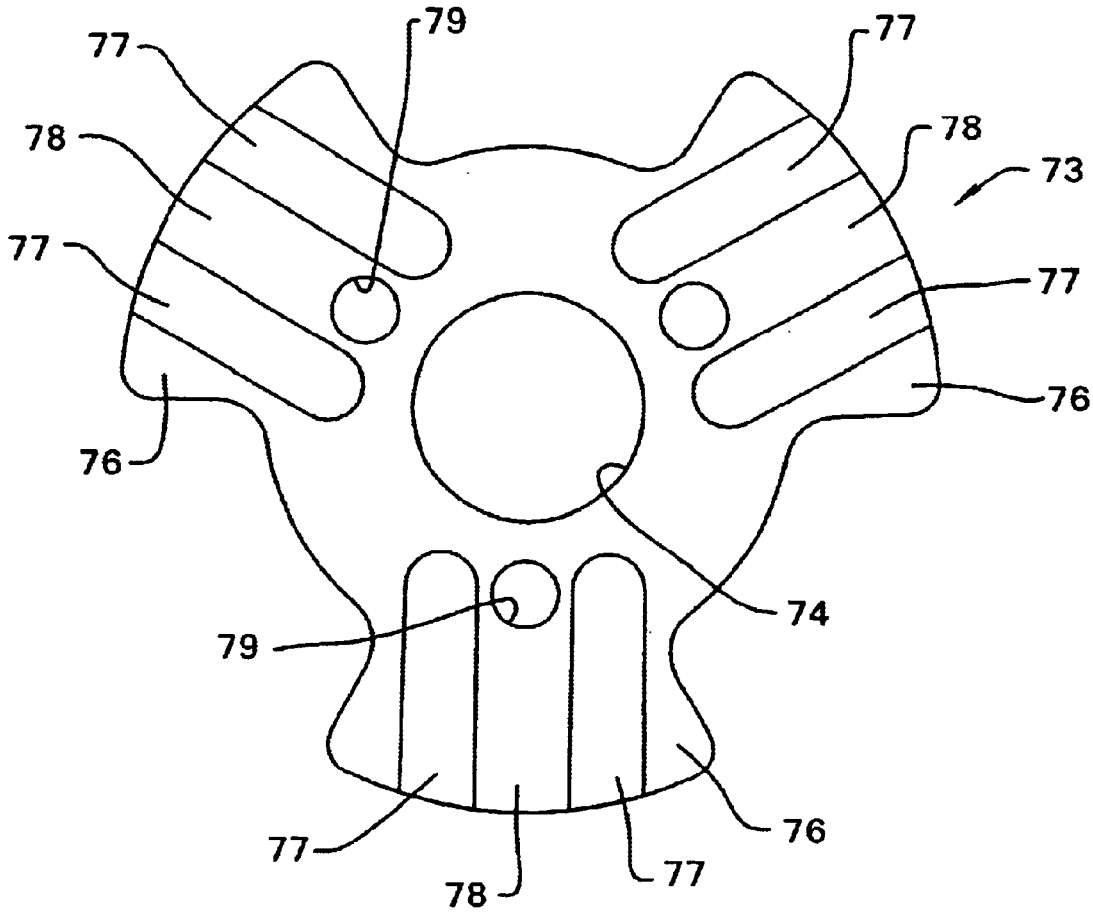
FIG. 11 is a top view of a spider of the FIG. 1 base unit.
Figure 12:
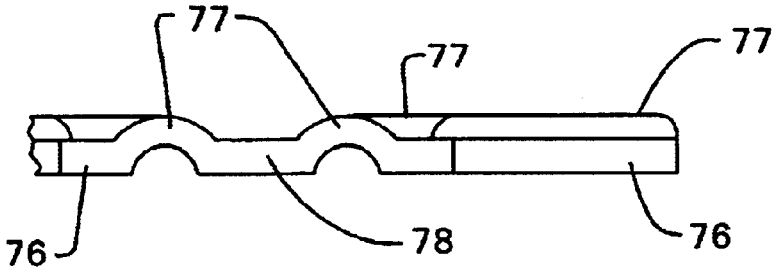
FIG. 12 is a side view of the FIG. 11 spider.

The mounting assembly 17 includes a spider 73 (FIGS. 11 and 12) that is composed of a suitable material, such as aluminum or steel. The spider 73 has a centrally positioned locator opening 74 (FIG. 11). The spider 73 has three legs 76 that extend radially outward. Each leg 76 is contoured to include two raised portions 77 separated by a downwardly extending central portion 78, as best illustrated in FIG. 12. A fastener hole 79 extends through each leg 76 (FIG. 11).

Referring now to FIGS. 15–19, the connector unit 13 includes a latch 81, here formed as a leaf spring, that has a fixed first end 82 (FIGS. 15A–15B) and a free second end 83. A fastener hole 84 extends through the first end 82 to facilitate attachment of the latch 81 to the post 12. The latch 81 is composed of a resiliently bendable material. The latch 81 is mountable on the post 12 so the second end 83 can flex toward and away from the post 12.

Figure 16A:
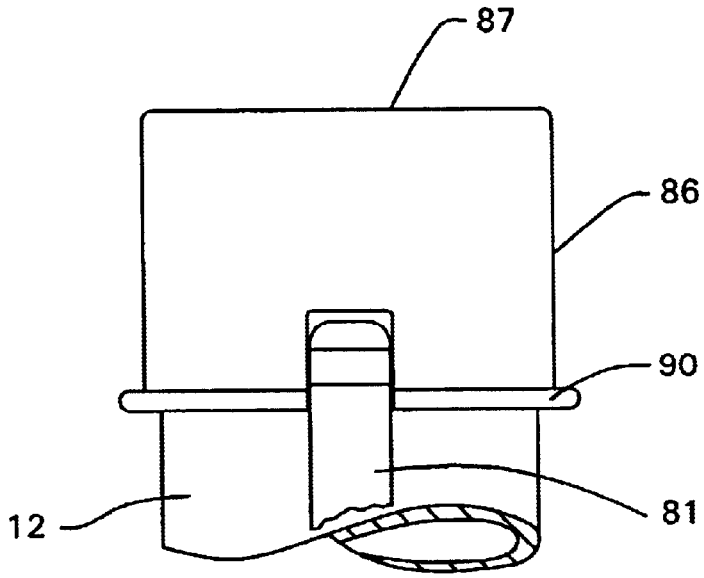
FIG. 16A is a front view of an end cap for use with the connector unit of the FIG. 1 pedestal, wherein the end cap is secured to the upper end of the pedestal post.
Figure 16B:
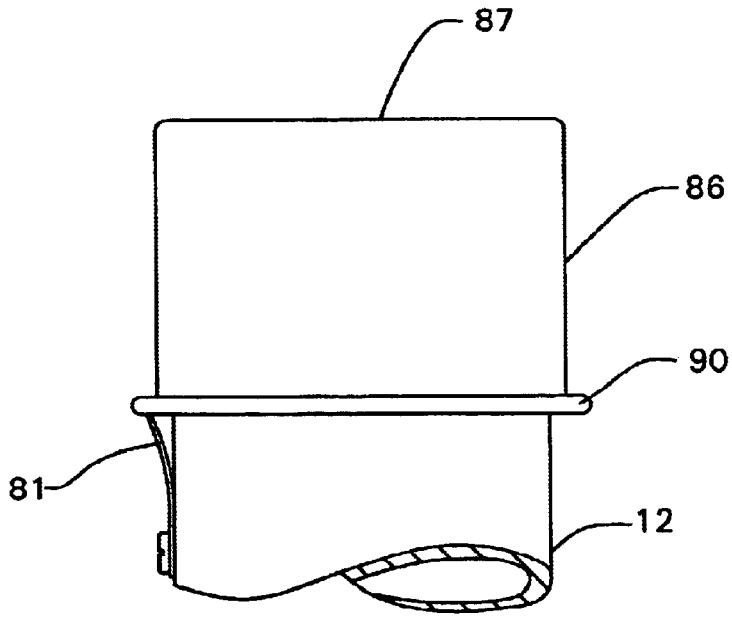
FIG. 16B is a side view of the upper end of the pedestal post of FIG. 1 with the connector assembly end cap attached.
Figure 17:
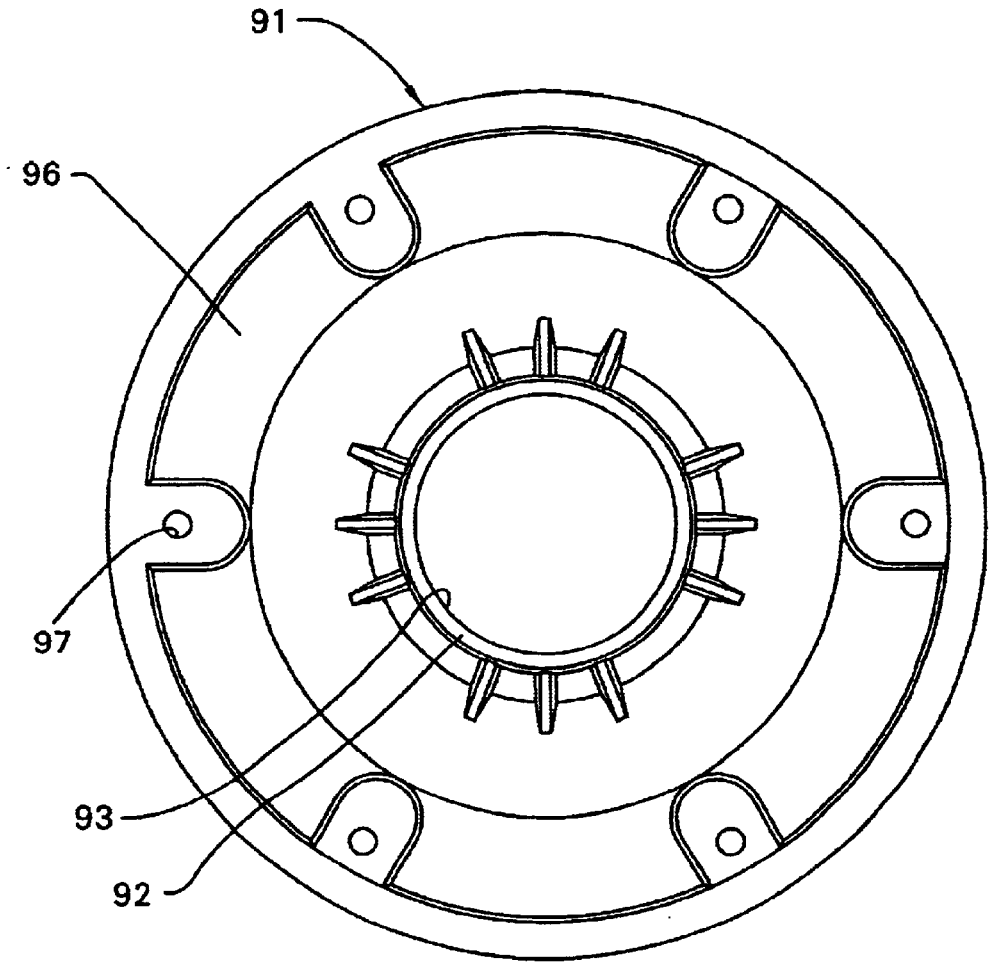
FIG. 17 is a top view of a connector member for use with the connector unit of FIG. 1.
Figure 18:
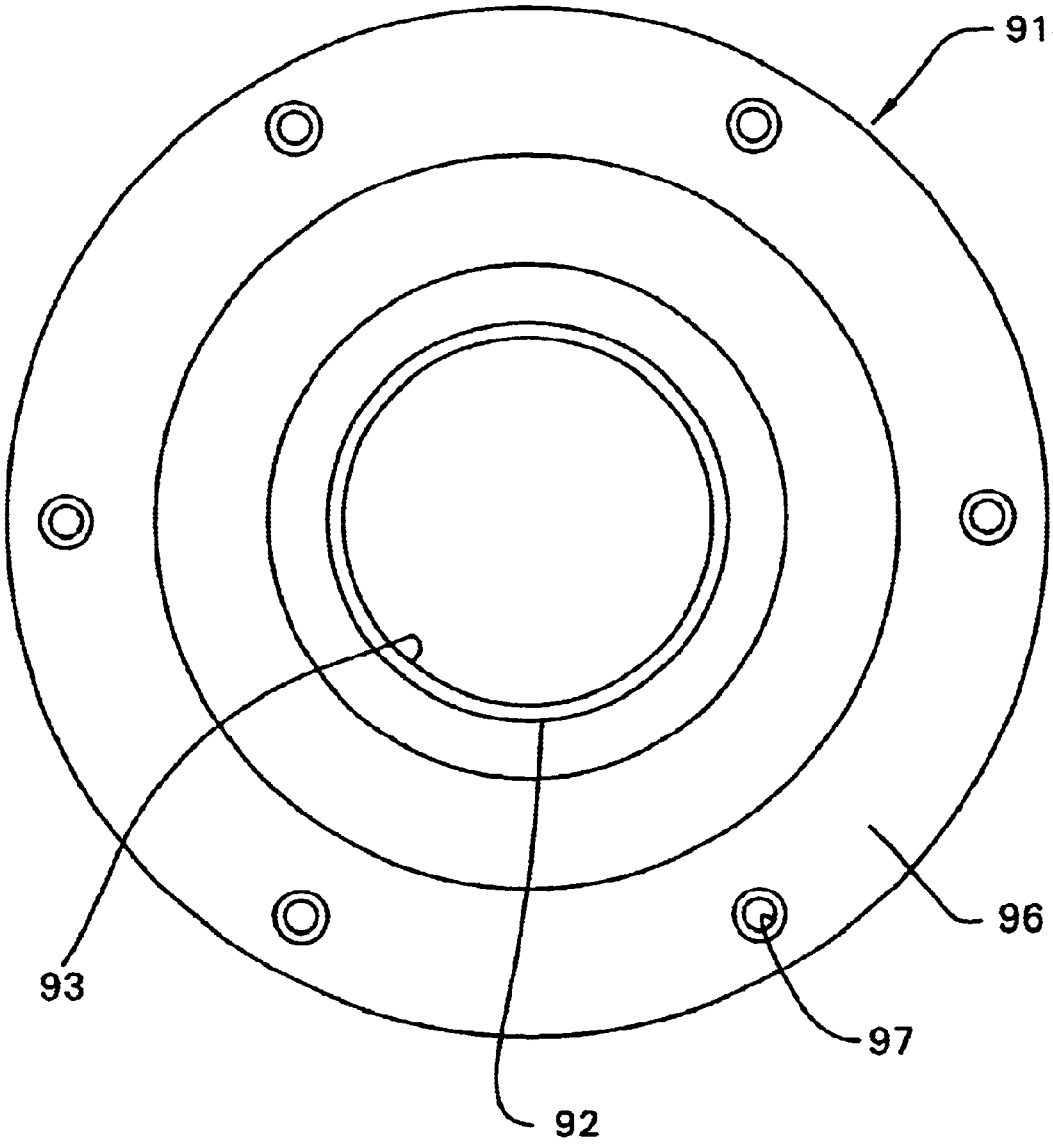
FIG. 18 is a bottom view of the FIG. 17 connector member.
Figure 19:
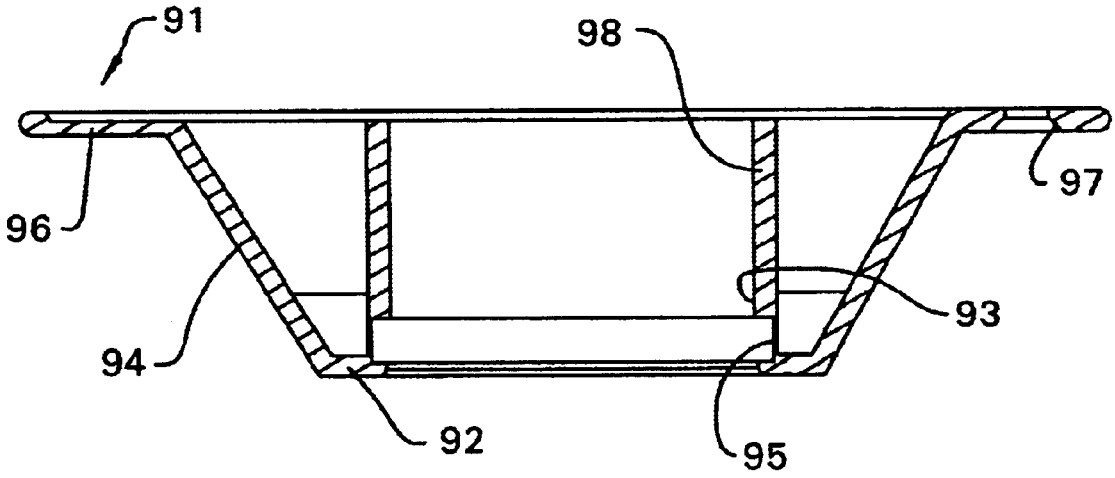
FIG. 19 is a cross sectional side view of the connector unit of the pedestal of FIG. 1.

Referring to FIGS. 16A–16B the connector unit 13 includes an end cap 86 having an end surface 87. The end cap 86 includes a central interior opening 88 that is surrounded by an outer wall 89. The outer wall 89 extends axially away from the end surface 87 and terminates in a substantially annular protrusion 90.

The connector unit 13 includes a connector member 91 (FIGS. 17–19) that has a tapered outer wall 94 and an inner wall 98. The outer wall 94 connects a central plateau 92 to an annular flange 96 so that the annular flange 96 is stepped from the plateau 92. A central opening 93 is formed by the inner wall 98. An annular groove 95 is formed in a lower end of the inner wall 98. A plurality of spaced apart fastener holes 97 extend through the flange 96.

ASSEMBLY

To assemble the pedestal 10, the base 16 is mounted on the floor f. The base 16 is first positioned in the desired location on the floor f. Screws S are then inserted through the fastener holes 22 and tightened to secure the base 16.

The mounting assembly 17 is then assembled. The screw mounting block 49 is dropped into the end cap 36 so that it rests on the end wall 37. Due to its configuration, the screw mounting block 49 can only be received in the lower end 18 of the post 12 with the legs 51 extending between the buttresses 44. Thus, when the screw mounting block 49 is positioned on the end wall 37 of the end cap 36, the fastener holes 52 will be aligned with the fastener holes 47 of the end wall 37.

Figure 14A:
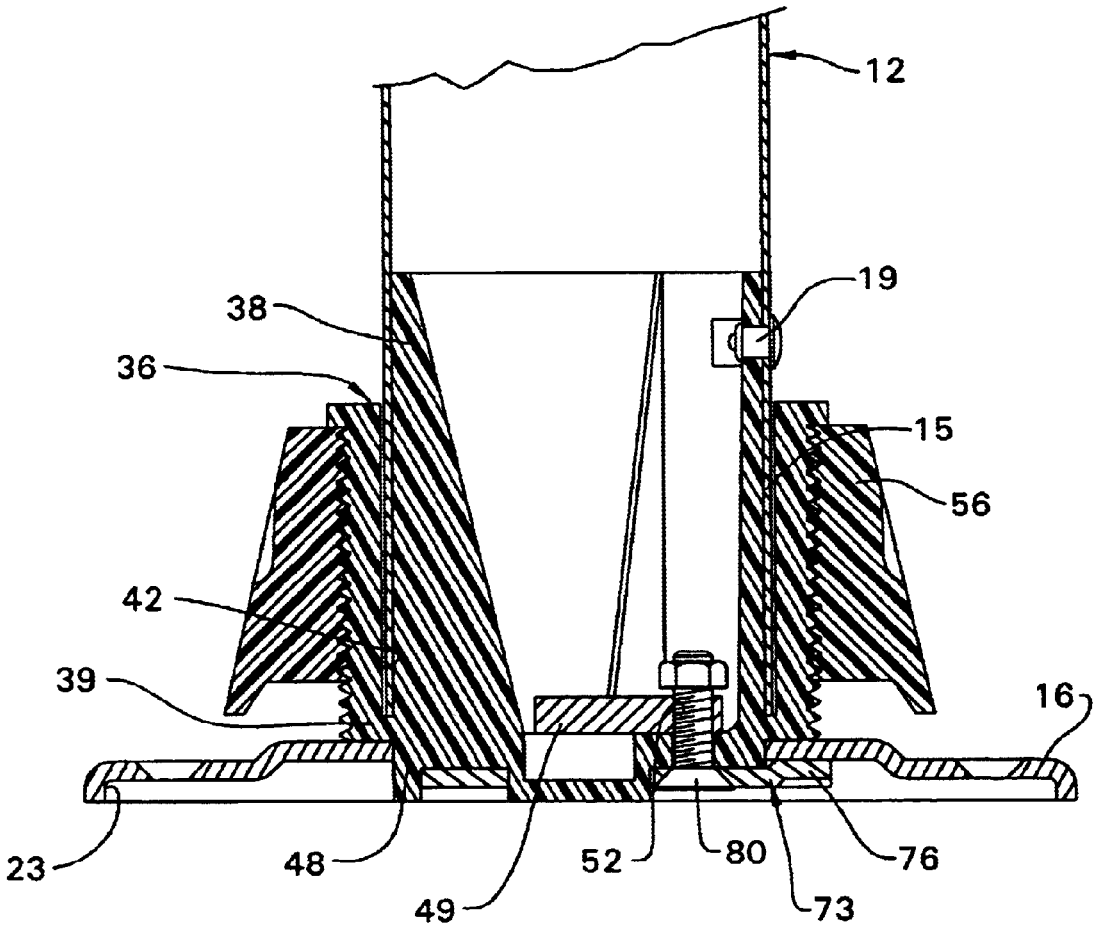
FIG. 14A is a cross sectional view, substantially as viewed along the line XIV—XIV, of the lower end of the pedestal of FIG. 1 illustrating the annular member in its first axial position with respect to the pedestal.

The nut 56 is then positioned around the end cap 36. The nut 56 is secured to the end cap 36 by a mating of the internal threads of the nut 56 with the external threads of the end cap 36. The nut 56 is advanced about the end cap 36 until the top end 61 of the nut 56 abuts the rim 41 of the outer wall 39 of the end cap 36 (FIG. 14A). The nut 56 is now in a first axial position with respect to the end cap 36.

Once the nut 56 is in its first axial position, the spider 73 is attached to the end wall 37 of the end cap 36. To mount the spider 73, the locator 46 of the end wall 37 is positioned in the locator opening 74 of the spider 73. The spider 73 is then oriented so the fastener holes 79 in the legs 76 are aligned with the fastener holes 47 in the end wall 37 and the fastener holes 52 of the screw mounting block 49. A screw 80 or other suitable fastener is tightened in each set of fastener holes 52, 79 and 47 to secure the spider 73 to the end wall 37. The raised portions 77 of each leg 76 are adjacent the end wall 37. The central portion 78 of each leg 76 of the spider 73 projects downwardly away from the end wall 37 of the end cap 36. When assembled, the legs 76 of the spider 73 extend outward between adjacent ribs 48 of the end cap 36 (FIG. 14A).

Figure 13A:
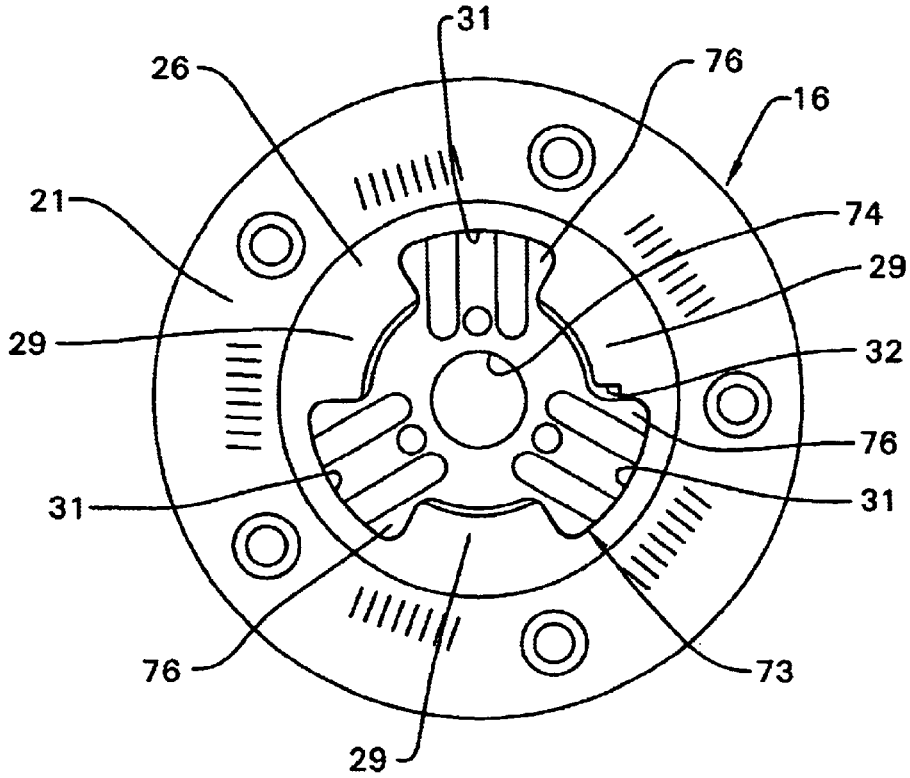
FIG. 13A is a top view, substantially as viewed along the line XIII—XIII, of the base unit of FIG. 1 illustrating the spider in a first circumferential position with respect to the base.
Figure 13B:
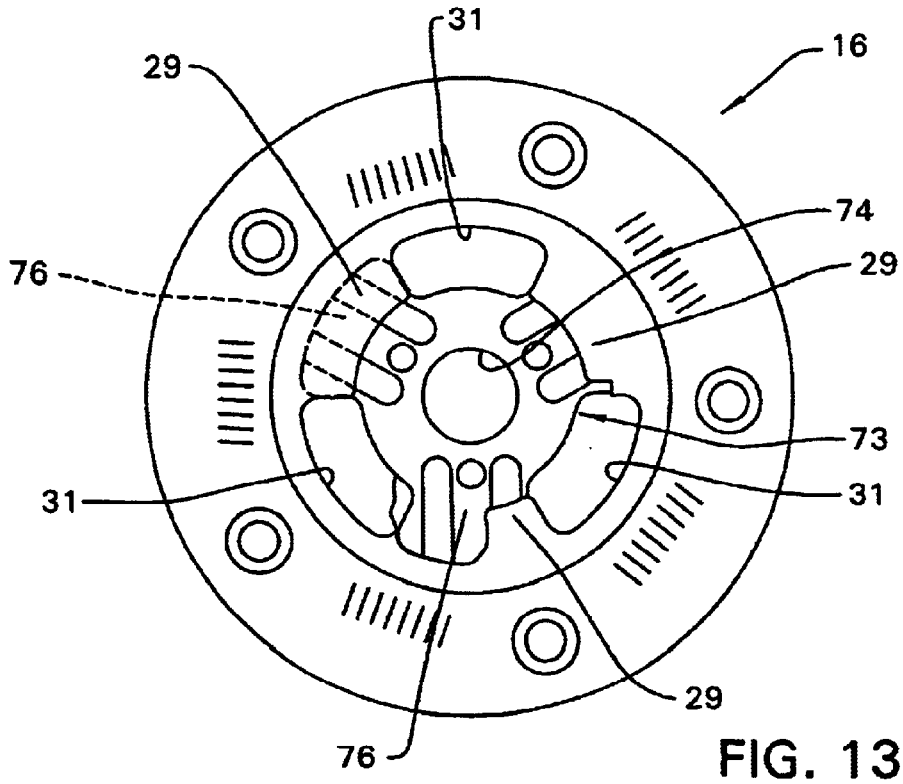
FIG. 13B is a view similar to FIG. 13A but illustrating the spider in a second circumferential position with respect to the base.

Once the spider 73 is secured to the end cap 36, the post 12 can be secured to the mounting assembly 17. The lower end 18 of the post 12 is inserted into the end cap 36 so the lower end 18 is positioned in the annular groove 42 between the inner and outer walls 38 and 39 of the end cap 36. The lower end 18 of the tube 12 can be secured to the end cap by an adhesive, such as glue. The end cap 36 is preferably also secured to the post 12 by a fastener 19 which will further prevent the end cap 36 from axial and/or rotational movement with respect to the post 12. Once the mounting assembly 17 is secured to the post 12, the post 12 is positioned over the base 16 so that each leg 76 of the spider 73 is positioned in the central opening 28 of the base 16 and axially extends into a notch 31 between adjacent tongues 29 so as to be offset from the tongues 29, as illustrated in FIG. 13A. The base 16 is now in a first circumferential position with respect to the post 12. The post 12 is then rotated with respect to the base 16 so that the base 16 is in a second circumferential position with respect to the post (FIG. 13B). When the base 16 is in this position, each leg 76 of the spider 73 is positioned beneath one of the base tongues 29. One of the legs 76 abuts the stop 32 of the base 16. Each leg 76 is thus axially trapped by a respective tongue 29 to prevent axial movement of the base 16 with respect to the post 12.

Figure 14B:
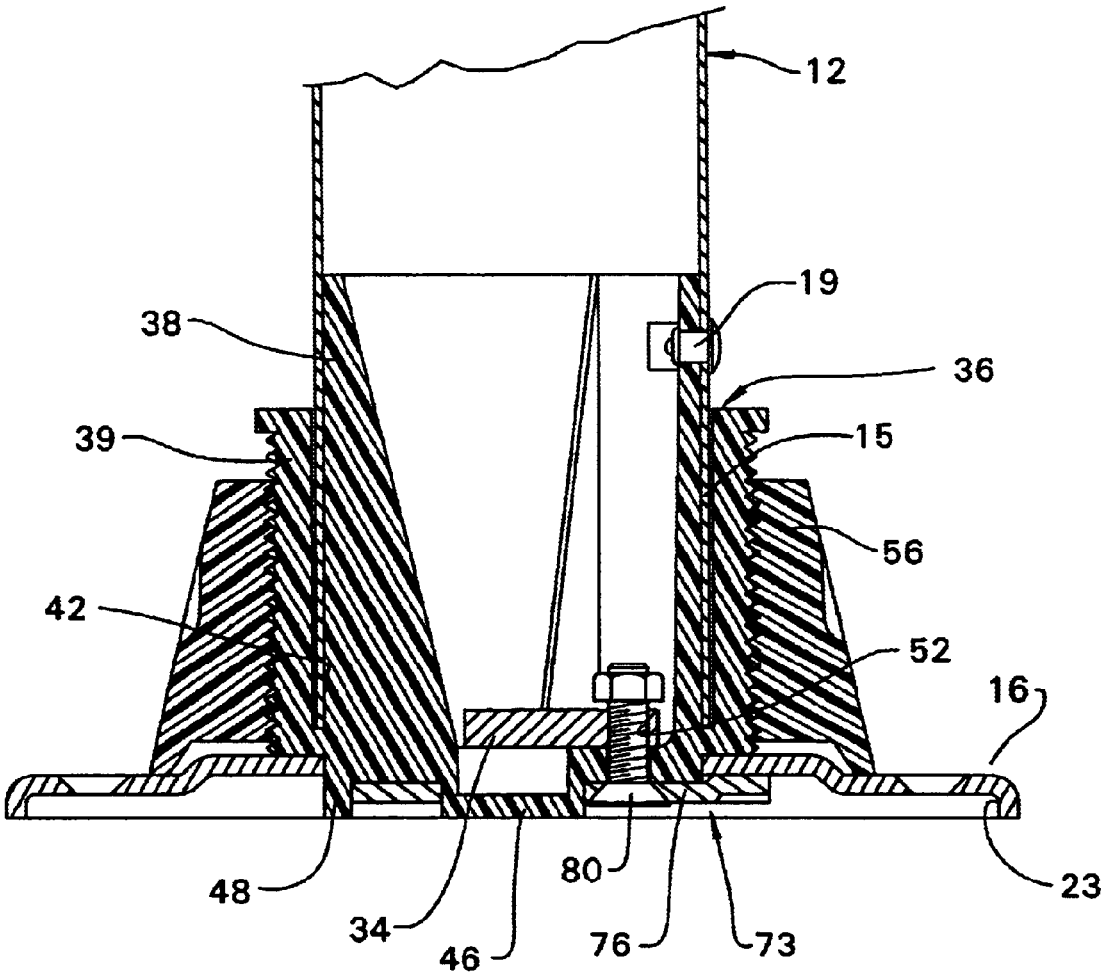
FIG. 14B is a view similar to FIG. 14A but illustrating the annular member in its second axial position with respect to the base.
Figure 15A:
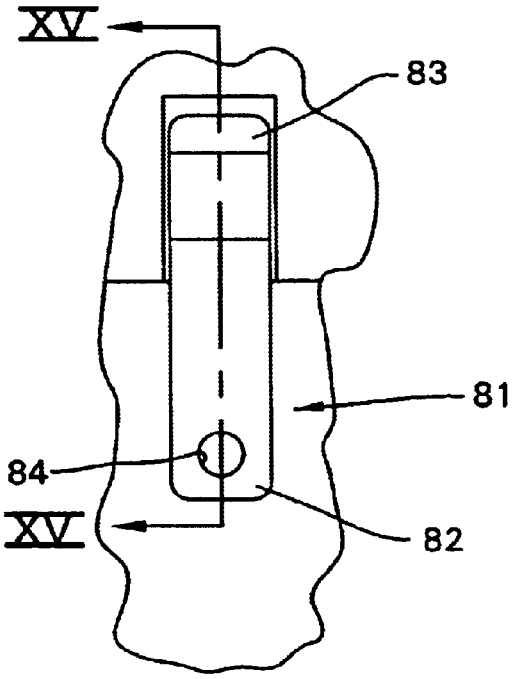
FIG. 15A is a front view of a latch for attachment to the pedestal and engagement of the connector member of FIG. 1.
Figure 15B:
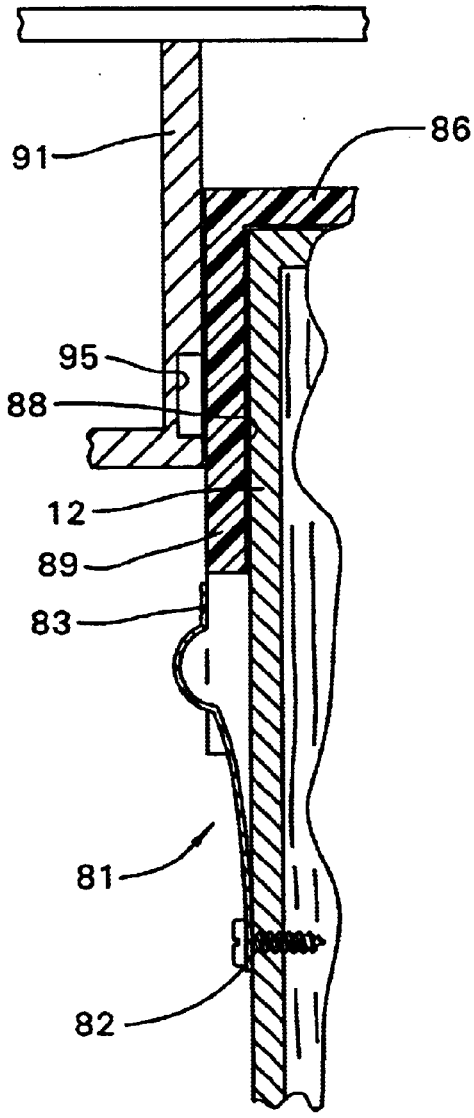
FIG. 15B is a cross sectional side view of the latch of FIG. 15A.

After the base 16 is moved to the second position, the nut 56 is moved to its lower position so the edge 68 of the nut 56 engages the flange 21, as illustrated in FIG. 14B. The nut 56 is now tightened over the base 16 to further secure the base 16 in its second position. In addition, since the edge 68 of the nut 56 and the flange 21 are scored, these surfaces will frictionally interact to further inhibit movement of the base 16 with respect to the post 12. Thus, pedestal 10 can provide a stable and sturdy base for the object supported thereon. Furthermore, since the open notches 31 of the base opening 28 are covered by the nut 56, the overall aesthetic appearance of the pedestal 10 will be visually pleasing.

To complete assembly of the pedestal 10, the connector unit 13 is secured to the upper end 15 of the post 12. A suitable fastener is inserted through the fastener hole 84 of the latch 81 and a complementary hole in the upper end 15 of the post 12 to secure the latch 81 to the post. The top end 12 of the post 12 is then inserted in the central opening 88 of the end cap 86. The connector member 91 is then positioned over the end cap 86 so the end cap 86 is received in the passage 93. The protrusion 90 on the outer wall 89 opposes the plateau 92 and limits the distance the connector member 91 can be displaced toward the mid-section of the post 12. As the connector member 91 slides over the top end 12, the annular groove 95 of the connector member 91 is engaged by the latch 81 on the upper end 15 of the post 12. Once the opening is engaged by the latch 81, the connector member 91 is prevented from both axial and circumferential movement with respect to the post 12.

Once the connector unit 13 is secured to the post 12, the tabletop 14, or other desired item to be supported, can be mounted thereon. To mount the tabletop 14, it is first centered over the pedestal 10. Bolts or other suitable fasteners are then inserted through the bores on the connector flange and into the bottom surface of the tabletop 14. It should be appreciated that the tabletop 14 or other item could be mounted to the pedestal 10 before the pedestal 10 is mounted to the floor. Similarly, the base 16 could be mounted to the floor prior to being secured to the post 12.

MODIFICATION

Figure 20:
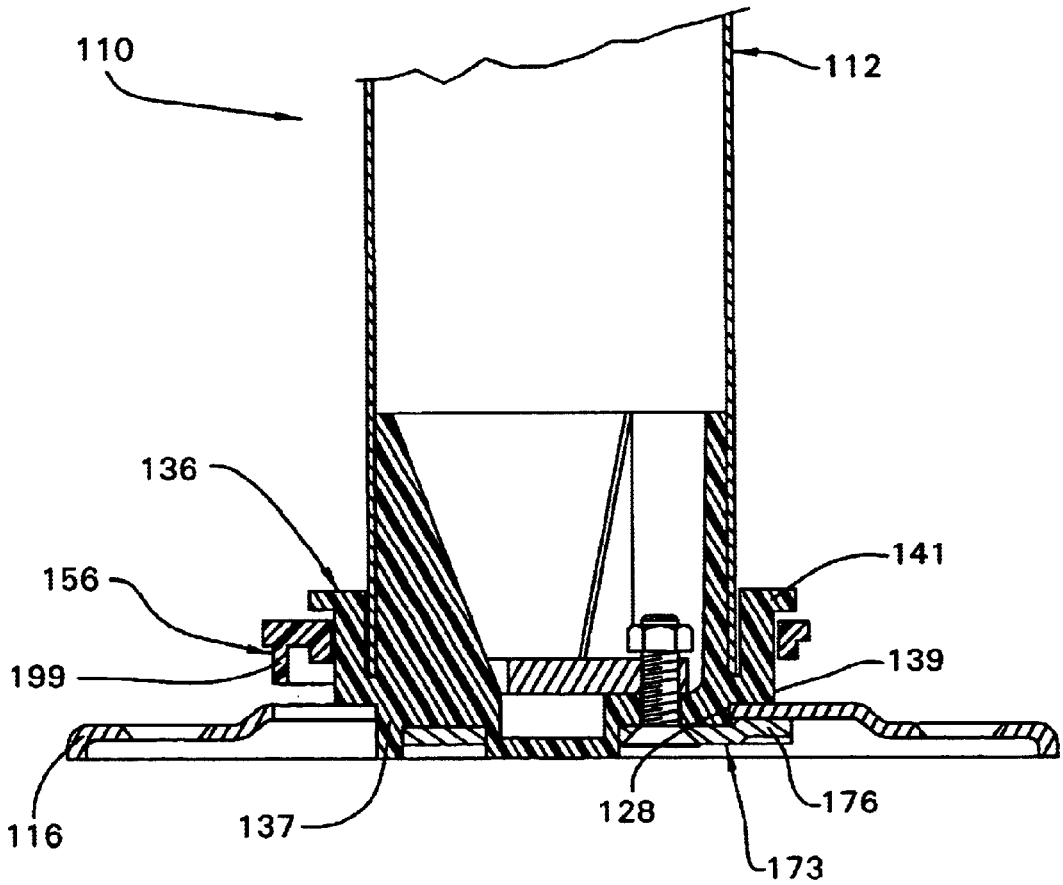
FIG. 20 is a cross sectional view of the lower end of a pedestal according to an alternate embodiment of the present invention, and showing the annular member in its first position.
Figure 21:
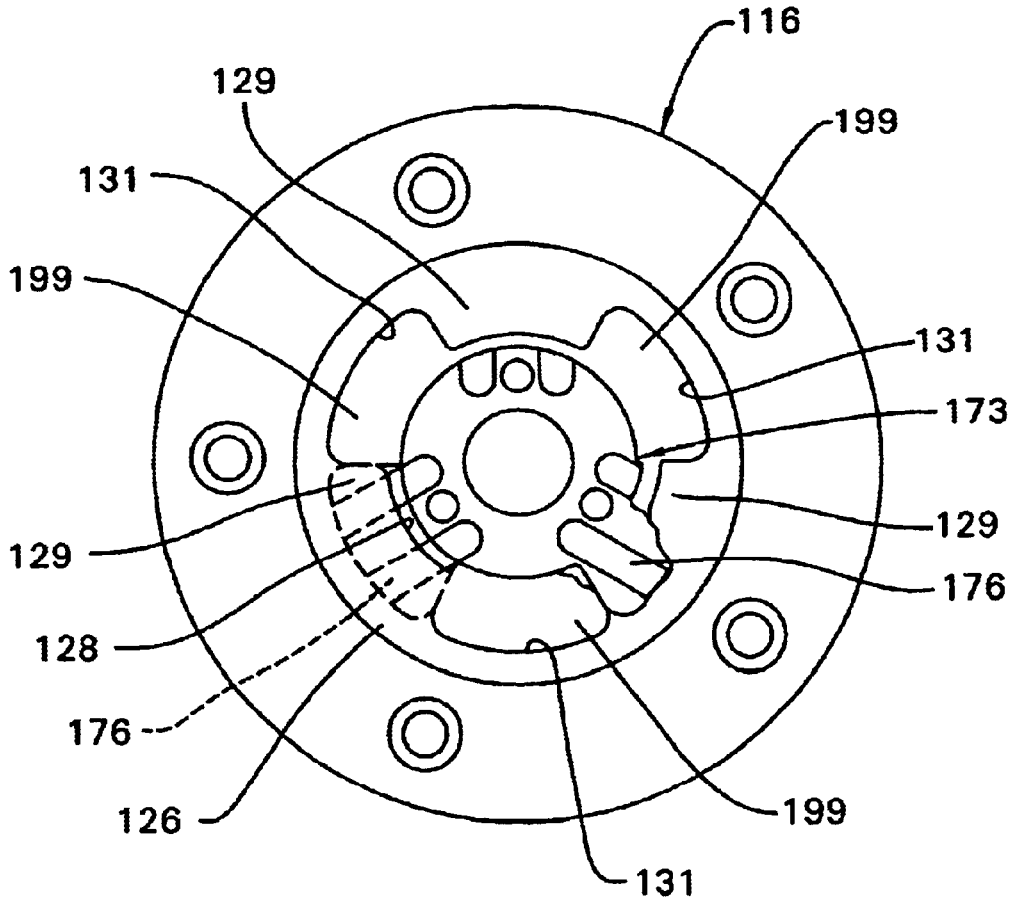
FIG. 21 is a top view of the pedestal of FIG. 20 illustrating the annular member in its second position.
Figure 22:
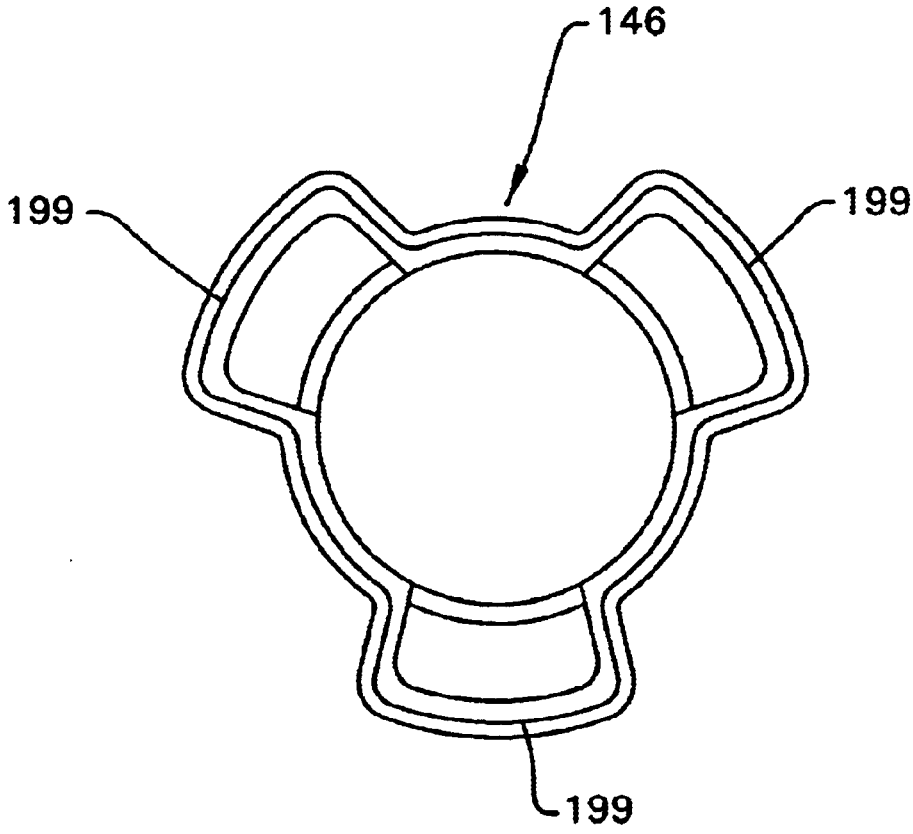
FIG. 22 is a bottom view of the annular member of FIG. 20.

FIGS. 20–22 show a modified mountable pedestal 110. The modified pedestal 110 is preferably identical to the previously disclosed pedestal 10, except as described hereafter. Parts of the pedestal 110 that are similar to parts of the pedestal 10 carry the same reference numerals with the prefix "1" added thereto.

Figure 23:
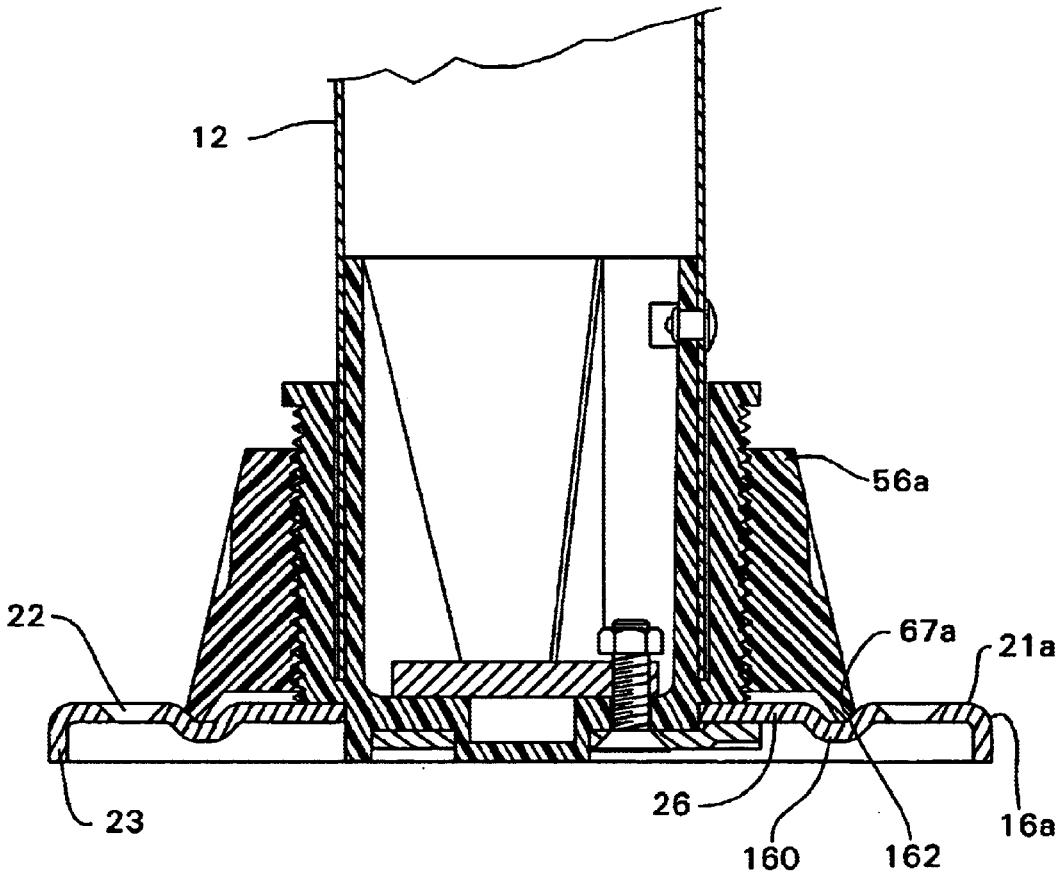
FIG. 23 is a cross sectional view similar to FIG. 14B illustrating an alternative base and a nut of this invention and how these components interact.

FIG. 23 illustrates an alternative base 16*a* and nut 56*a* of this invention. Base 16*a* is formed so as to have an outer flange 21*a* that is the same height or slightly higher than the inner-located center plateau 26. Between the outer flange 21*a* and center plateau 26, base 16*a* is formed to have a circular track 160 that is recessed relative to both the outer flange 21*a* and the center plateau 26. A diagonally upwardly directed circular lip 162 is the portion of the base 16*a* that connects track 160 to the outer flange 21*a*.

Nut 56*a* is formed to have a free end 67*a* that is outwardly beveled. More particularly, the angle of inclination of base lip 162 and nut free end 67*a* are similar, if not identical. One or both of the outer surfaces of the nut free end 67*a* and the base lip 162 may be scored. The base 16*a* and the nut 56*a* are collectively shaped so that when the nut is screwed against the base, the nut free end 67*a* seats against the base lip 162. Owing to the outward circumferential contact between the surfaces of these components, lateral movement of the nut 56*a* and, consequently, of the post 12 is restrained.

In other alternative versions of this embodiment of the invention, it may be desirable to form that base so that the outer flange is the highest portion of the base, relative to the rim 23. In these versions of the invention, the circular, diagonally oriented lip located between the inner edge of the outer flange and the inner portions of the base would serve the same function as the above described base lip 162. The base of these versions of the invention may not require the above-described recessed track.

Also, in alternative versions of the invention, the fastener holes 22 formed in the base may be positioned within the inner portion of the base subtended by the nut free end. Thus, in these versions of the invention, once the mounting assembly is fully assembled, the fastener holes, as well as the fasteners seated in them, are concealed from view.

Figure 20A:
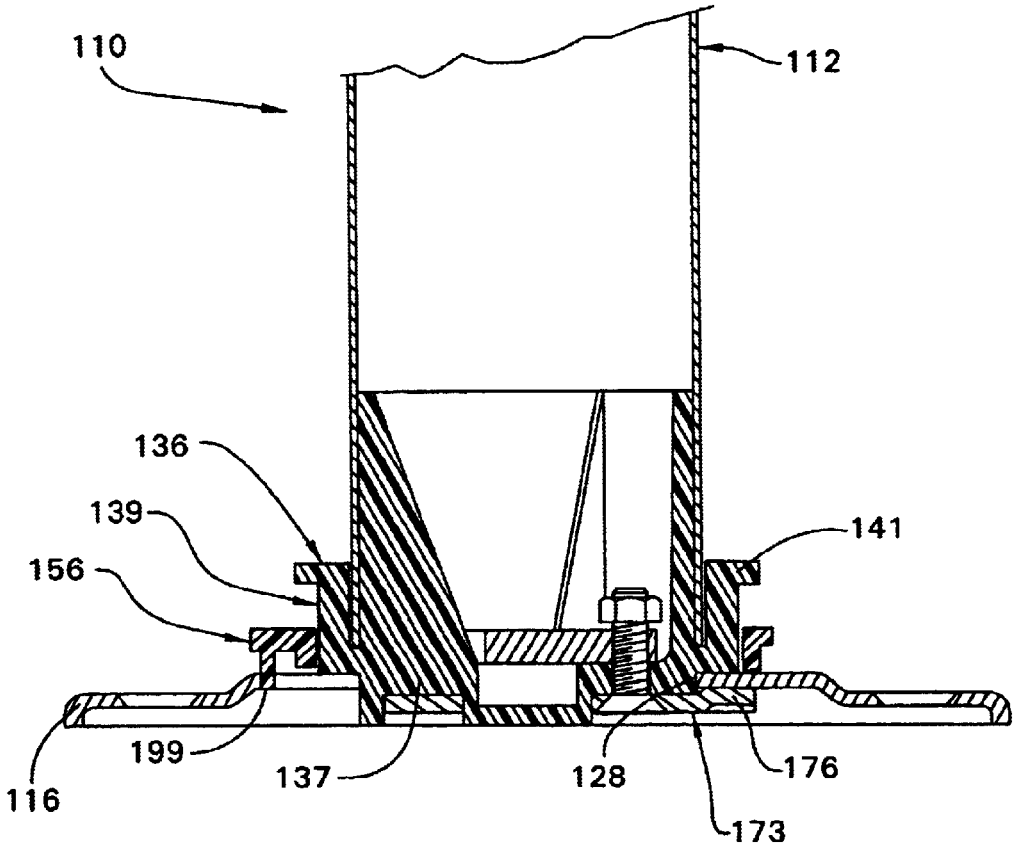
FIG. 20A is a view similar to FIG. 20 but showing the annular member in its second position.

The pedestal 110 preferably replaces the threaded end cap 36 of the pedestal with the end cap 136 (FIGS. 20 and 21). The end cap 136 has a relatively short outer peripheral wall 139 that extends upward from the end wall 137 of the end cap 136 and terminates in a radially outwardly extending rim 141. An annular slider 156 is substituted for the nut 56 of the pedestal 10. The annular slider 156 includes three blocks 199 (FIGS. 21–22) that extend downward toward the base 116. The slider 156 is movable along the post 112 between a first axial position spaced apart from the spider 173 (FIG. 20) and a second axial position (FIG. 20A). The slider 156 is prohibited from moving beyond the first axial position away from the second axial position by the rim 141.

When the base 116 is in its second circumferential position with respect to the post 112, the legs 176 of the spider 173 are once again axially trapped by the tongues 129 of the base 116. Thus, the base 116 is prevented from axial movement with respect to the post 112 and inhibited by the engagement of the legs 176 of the spider 173 and the tongues 129 of the central plateau 126 from circumferential movement. When the base 116 is in this position, the slider 156 is moved to its second position so that each block 199 is received in one of the three notches 131 of the base central opening 128 (FIG. 21). Thus, the base 116 is prevented from rotational movement about the post 112. In addition, since the notches 131 of the base 116 are covered by the blocks 199 of the slider 156, the aesthetic qualities of the post 112 are enhanced.

It should be appreciated that the foregoing description is for the purposes of illustration only, and further alternative embodiments of this invention are possible without departing from the scope of the claims. For instance, while the pedestal of the present invention has been illustrated with only one base unit that is secured to the lower end of the post, this is not intended to limit the scope of the invention. Indeed, the pedestal could instead be configured to receive a base unit that is attached to the upper end of the post. This configuration could find a particular application with home or office furniture. In addition, the pedestal could be configured to receive a base unit on both the upper and lower ends of the post. This would provide a positive locking attachment at both the upper and lower ends. Thus, the pedestal need not include a connector assembly on either end.

In addition to the above modifications, when the present invention includes a connector assembly on either end, any suitable connector assembly could be substituted for the snap lock connector assembly illustrated. Additionally, while a spider having three prongs has been illustrated herein, it should be appreciated that a spider having any sufficient number of prongs could instead be used. For instance, a spider having either two or four prongs could be substituted to lock the pedestal in the desired position. However, it should also be appreciated that the number of legs should be equal to the number of ribs that project downward from the end cap and the number of tongues on the central plateau of the base.

Thus, although particular preferred embodiments of the present invention have been disclosed in detail for illustrative purposes, it will be recognized that variations or modifications lie within the scope of the present invention and do not depart from the spirit of the invention.

What is claimed is:

1. A pedestal mountable on a first support structure for carrying a second support structure in spaced relation to the first support structure, the pedestal comprising:

an elongate post having a threaded portion, a base releasably fixed to said post and comprising a substantially annular flange, a central plateau surrounded by said substantially annular flange and having a central opening, at least one tongue on said plateau extending into said central opening, and a rim protruding from said substantially annular flange and spaced radially outboard of said plateau;

a spider fixed at an end of said post and having at least one radially outwardly extending leg, said post having a first circumferential position with respect to said base in which said at least one leg of said spider is located in said base central opening circumferentially offset from said at least one tongue, said post having a second circumferential position with respect to said base in which said at least one leg of said spider snugly underlies and is axially trapped by said at least one tongue, said first and second post positions being circumferentially spaced, one of said at least one tongue and at least one leg having a circumferentially extending ramp surface tightly camingly engaged with an opposed surface of an other of said at least one tongue and at least one leg in said post second position, said leg in said post second position axially tightly abutting said tongue; and a nut threaded on said post threaded portion, said nut having a first axial position threaded relatively distantly from said spider and a second axial position threaded nearer to said spider, said nut in said nut second position snugly engaging said base so that said base is tightly gripped between said spider and nut.

2. The apparatus of claim 1 in which said annular flange and plateau are joined by an axially extending annular portion, said flange having circumferentially spaced fastener holes, said central opening having a peripheral edge defined by a plurality of said tongues circumferentially separated by a plurality of circumferentially extending notches.

3. The apparatus of claim 2 wherein said nut has a generally cup-shaped end portion opening toward said base and including a central recess surrounded by a skirt extending toward said base, said recess being of greater axial extent than said axially extending annular portion.

4. The apparatus of claim 1, in which said post comprises an elongate rigid tube and a generally cup shaped end cap on an end of said tube, said end cap having an outside circumferential surface defining said threaded portion of said post.

5. The apparatus of claim 4, in which the generally cup shaped end cap has an end wall adjacent an end of a post and radially inner and outer peripheral walls extending substantially axially from the end wall and toward an intermediate part of said post, said threaded portion of said post comprising threads on said outer peripheral wall, said peripheral walls being radially spaced by an annular groove open axially toward an intermediate part of said post, and said end of said tube being snugly and fixedly received in said groove.

6. The apparatus of claim 1 in which said spider has a plurality of circumferentially spaced legs with said generally circumferentially extending ramp surface being on selected ones of said legs, a central locator opening, and fastener holes radially interposed between said central locator opening and legs.

7. The apparatus of claim 6 in which said post has a central locator protrusion engagable in said spider central locator opening and centering said spider on an end of said post.

8. The apparatus of claim 1 in which said nut has a peripheral surface tapered away from said base, a textured hand engagable area, a narrow end facing away from said base, and a wide end facing toward said base and recessed to clear said plateau, said wide end having a skirt bounding said recess and of axial length to frictionally engage said base flange.

9. The apparatus of claim 1 in which said post has a radially outwardly extending rib axially opposing said nut and blocking displacement of said nut axially therepast, said nut being located on said post between said rib and said post end.

10. A pedestal mountable on a first support structure for carrying a second support structure in spaced relation to the first support structure, the pedestal comprising:

an elongate post;

a base releasably fixed to said post and comprising a substantially annular flange, a central plateau surrounded by said substantially annular flange, and having a central opening, at least one tongue on said plateau extending into said central opening, and a rim protruding from said substantially annular flange and spaced radially outboard of said plateau;

a spider fixed at an end of said post and having at least one radially outwardly extending leg, said post having a first circumferential position with respect to said base in which said at least one leg of said spider is located in said base central opening circumferentially offset from said at least one tongue, said post having a second circumferential position with respect to said base in which said at least one leg of said spider snugly underlies and is axially trapped by said at least one tongue, said first and second post positions being circumferentially spaced, one of said at least one tongue and at least one leg having a circumferentially extending ramp surface tightly camingly engaged with an opposed surface of an other of said at least one tongue and at least one leg in said post second position, said leg in said post second position axially tightly abutting said tongue; and a slider axially slidably mounted on said post, said slider having a first axial position relatively distant from said spider and a second axial position adjacent a lateral plane of said spider and engaging said base, said slider including a substantially annular carrier and at least one block fixed on said carrier and extending therefrom toward said base in said second position.

11. The apparatus of claim 10 in which said annular flange and said plateau are joined by an axially extending portion, said flange having circumferentially spaced fastener holes, said central opening having a peripheral edge defined by a plurality of said tongues circumferentially separated by circumferentially extending notches.

12. The apparatus of claim 10 in which said post comprises an elongate rigid tube and a generally cup shaped end cap on an end of said tube, said end cap having an outside circumferential surface.

13. The apparatus of claim 12, in which said generally cup shaped end cap has an end wall adjacent said end of said post and radially inner and outer peripheral walls extending substantially axially from said end wall and toward an intermediate part of said post, said peripheral walls being radially spaced by an annular groove open axially toward said intermediate part of said post, and said end of said tube being snugly and fixedly received in said groove.

14. The apparatus of claim 10 in which said spider has a plurality of circumferentially spaced legs with said generally circumferentially extending ramp surface being on selected ones of said legs, a central locator opening, and fastener holes radially interposed between said central locator opening and legs.

15. The apparatus of claim 14 in which said post has a central locator protrusion engagable in said spider central locator opening and centering said spider on an end of said post.

16. The apparatus of claim 10 wherein said base includes at least two said tongues circumferentially separated by a notch.

17. The apparatus of claim 16 in which said post has a radially outward extending rib axially opposing said slider and blocking displacement of said slider axially therepast, said slider being located on said post between said rib and said post end.

18. A pedestal mountable on a first support structure for carrying a use structure in spaced relation to the first support structure, the pedestal comprising:

an elongate post;

a connector member comprising a substantially annular flange, a central plateau surrounded by and stepped from said flange and having a central passage, a step in said passage and facing generally away from said plateau, said passage being sized to snugly axially receive an end portion of said post;

a radially outwardly extending protrusion fixed on said post opposing said plateau and defining a limit to axial displacement of said connector member toward an intermediate part of said post; and a latch axially fixed on said post and located to engage said step and maintain said connector member against unintended displacement off said post.

19. The apparatus of claim 18, in which at least one of said latch and said step is releasably radially shiftably mounted and has a displacement direction away from an other of said step and said latch to allow removal of said connector member from said post.

20. The apparatus of claim 19 including an axially opposed pair of said steps, said steps being substantially annular and defined by a substantially annular groove in said passage, said latch being a leaf spring fixed on said post inboard of said connector member, said passage having a slot extending from said groove through said central plateau but of lesser radial depth than said groove, said slot being of circumferential width exceeding the circumferential width of said leaf spring, said leaf spring extending through said slot and having a radial protrusion receivable in said annular groove and resiliently radially outwardly pressed thereinto, said protrusion being radially resiliently spaced outward from said post, said protrusion cooperating with said opposed steps to axially locate the said connector member axially on said post.

21. A pedestal mountable on an environmental surface for carrying an object support spaced from the environmental surface, the pedestal comprising:

an elongate posts;

a base mountable on an environmental surface and having an opening defining a notch and a tongue extending into said opening beside said notch;

said post having a generally radially extending portion in turn having a first position with said portion inserted in said notch and having a second position with said portion axially trapped behind said tongue, said first and second post positions being laterally offset; and an annular member sleeved on and axially movable on said post, said member having a first axial position relatively distant from said portion and a second axial position engaging said base, in portion/tongue disengagement inhibiting relation.

22. The apparatus of claim 21 wherein said annular member comprises a slider axially slidably mounted on said post, said slider including a substantially annular carrier and at least one block fixed on said carrier and extending therefrom toward said base, said block in said second axial position occupying said notch and blocking displacement of said portion from behind said tongue.

23. The apparatus of claim 21 in which said post has a threaded portion adjacent said generally radially extending portion, said annular member comprising a nut threaded on said post threaded portion, said nut in said first axial position being threaded relatively distantly from said radially extended portion, said nut in said second axial position snugly engaging said base so that said base is tightly gripped between said generally radially extended portion and nut.

24. A pedestal mountable on a first support structure for carrying a second support structure in spaced relation to the first support structure, the pedestal comprising:

an elongate post;

a base releasably fixed to said post; and an annular member sleeved on and axially movable on said post, said member having a first axial position relatively distant from said base and a second axial position engaging said base, in post/base disengagement inhibiting relation in which said base has a central opening and at least one tongue extending radially into said central opening, a spider fixed at an end of said post and having at least one radially outwardly extending leg, said post having a first circumferential position with respect to said base in which said at least one leg of said spider is located in said base central opening circumferentially offset from said at least one tongue, said post having a second circumferential position with respect to said base in which said at least one leg of said spider snugly underlies and is axially trapped by said at least one tongue, said first and second post positions being circumferentially spaced, one of said at least one tongue and at least one leg having a circumferentially extending ramp surface tightly camingly engaged with an opposed surface of an other of said at least one tongue and at least one leg in said post second position, said leg in said post second position axially tightly abutting said tongue.

25. A pedestal mountable on a first support structure for carrying a second support structure in spaced relation to the first support structure, the pedestal comprising:

an elongate post;

a base releasably fixed to said post; and an annular member sleeved on and axially movable on said post, said member having a first axial position relatively distant from said base and a second axial position engaging said base, in post/base disengagement inhibiting relation in which said base has a central opening with a radially inward extending tongue, said post having a radially extending leg releasably located under said tongue, said post having a threaded portion adjacent said leg, said annular member comprising a nut threaded on said post threaded portion, said nut in said first axial position being threaded relatively distantly from said leg and in said second axial position being threaded nearer to said leg, said nut in said second axial position snugly engaging said base so that said base is tightly gripped between said leg and nut.

26. The apparatus of claim 25 in which said nut and said base have a frictionally engaging interface frictionally holding said nut in said second axial position.

27. The apparatus of claim 26 wherein said nut has a generally cup-shaped end portion opening toward said base and including a central recess surrounded by a skirt extended toward said base.

28. The apparatus of claim 27 in which said base comprises an annular flange surrounding a central plateau and a generally axially extending annular lip between said flange and plateau, said nut laterally engaging said lip, so as to interfere with lateral movement of said post with respect to said base.

29. a pedestal mountable on a first support structure for carrying a second support structure in spaced relation to the first support structure, the pedestal comprising:

an elongate post;

a base releasably fixed to said post said base having a central opening with a radially extending tongue, said post having a radially oppositely extending leg, said post having a first position free of said base in which said leg is circumferentially offset from said tongue, said post having a second position fixed to said base in which said post is axially and circumferentially offset from said post first position and said leg is trapped axially behind said tongue; and an annular member sleeved on and axially movable on said post, said annular member having a first axial position relatively distant from said base and leg, and a second axial position (1) adjacent said leg and said base and (2) in post/base disengagement inhibiting relation with said leg and base.

30. The apparatus of claim 29 in which one of said tongue and leg has a circumferentially extending ramp surface tightly camingly engaged with an opposed surface of an other of said tongue and leg in said post second position, said leg in said post second position axially tightly abutting said tongue.

31. The apparatus of claim 30 in which said post has a radially outwardly extending rib axially opposing said annular member and blocking displacement of said annular member axially therepast, said annular member being located on said post between said rib and an end of said post.

32. The apparatus of claim 30 in which said post has a threaded portion adjacent said leg, said annular member comprising a nut threaded on said post threaded portion, said nut in said first axial position being threaded relatively distantly from said leg and in said second axial position being threaded nearer to said leg, said nut in said second axial position snugly engaging said base so that said base is tightly gripped between said leg and nut.

33. The apparatus of claim 32 in which said nut and said base have a frictionally engaging interface frictionally holding said nut in said second axial position.

34. The apparatus of claim 33 wherein said nut has a generally cup-shaped end portion opening toward said base and including a central recess surrounded by a skirt extended toward said base.

35. The apparatus of claim 29 in which said base comprises a substantially annular flange, a central plateau surrounded by said substantially annular flange and containing said central opening, said tongue is on said plateau, said flange has a plurality of circumferentially spaced fastener holes, and said central opening has a peripheral edge defined by a plurality of said tongues circumferentially separated by a plurality of circumferentially extending notches.

36. The apparatus of claim 29, in which said post comprises an elongate rigid tube and a generally cup shaped end cap on an end of said tube, said end cap has an outside circumferential surface, said generally cup shaped end cap has an end wall adjacent said end of said post and has radially inner and outer peripheral walls extending substantially axially from said end wall and toward an intermediate part of said post, said peripheral walls being radially spaced by an annular groove open axially toward said intermediate part of said post, and said end of said tube being snugly and fixedly received in said groove.

37. The apparatus of claim 29 including a spider fixed at an end of said post and carrying more than one said radially outwardly extending leg, and in which said spider has a plurality of circumferentially spaced legs with a generally circumferentially extending ramp surface being on selected ones of said legs, a central locator opening, and fastener holes radially interposed between said central locator opening and legs.

38. The apparatus of claim 37 in which said post has a central locator protrusion engagable in said spider central locator opening and centering said spider on an end of said post.

39. The apparatus of claim 29 wherein said base central opening has a periphery including at least two said tongues circumferentially separated by a notch, said notch and tongues being distributed circumferentially around the length axis of said post, said annular member comprising a slider axially slidably mounted on said post, said slider including a substantially annular carrier and at least one block fixed on said carrier and extending axially toward said base, said block in said second axial position being disposed in said notch and circumferentially opposing said leg.

40. The apparatus of claim 29 in which said annular member is axially aligned with said leg on said post.

* * * * *

UNITED STATES PATENT AND TRADEMARK OFFICE

CERTIFICATE OF CORRECTION

PATENT NO. : 6,820,847 B2
DATED : November 23, 2004
INVENTOR(S) : Richard J. Camarota et al.

It is certified that error appears in the above-identified patent and that said Letters Patent is hereby corrected as shown below:

Column 10,
Line 11, change “elongate posts” to -- elongate post --.

Column 11,
Line 34, change “a pedestal” to -- A pedestal --.

Signed and Sealed this

Thirteenth Day of September, 2005

JON W. DUDAS
*Director of the United States Patent and Trademark Office*